US007242399B2

(12) United States Patent
Onozawa et al.

(10) Patent No.: US 7,242,399 B2
(45) Date of Patent: Jul. 10, 2007

(54) CAPACITIVE LOAD DRIVE CIRCUIT AND PLASMA DISPLAY APPARATUS

(75) Inventors: Makoto Onozawa, Kawasaki (JP); Hideaki Ohki, Yokohama (JP); Masaki Kamada, Yokohama (JP); Kazuyoshi Yamada, Yokohama (JP); Eiji Ito, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 565 days.

(21) Appl. No.: 10/298,607

(22) Filed: Nov. 19, 2002

(65) Prior Publication Data

US 2003/0184539 A1 Oct. 2, 2003

(30) Foreign Application Priority Data

Mar. 26, 2002 (JP) ..... 2002-086225

(51) Int. Cl.
*G09G 5/00* (2006.01)

(52) U.S. Cl. ..... 345/212; 345/68; 345/67; 345/60; 345/61; 345/62; 345/204

(58) Field of Classification Search ..... 345/212, 345/204, 37, 55, 67–68, 60–62
See application file for complete search history.

(56) References Cited

U.S. PATENT DOCUMENTS 5,654,728 A 8/1997 Kanazawa et al. ..... 345/68
6,853,570 B2 * 2/2005 De Vries ..... 363/131
2002/0157925 A1 * 10/2002 Nasser-Moghaddassi et al. ..... 198/769

FOREIGN PATENT DOCUMENTS

| | | |
|---|---|---|
| EP | 1 030 286 | 8/2000 |
| EP | 1 065 650 | 1/2001 |
| EP | 1065650 A2 | 1/2001 |
| EP | 1 139 323 | 10/2001 |
| JP | 9-68946 | 3/1997 |
| JP | 2000-194316 | 7/2000 |
| JP | 1 065 650 A2 * | 1/2001 |
| JP | 3201603 | 6/2001 |

OTHER PUBLICATIONS

Weber et al., "Energy Recovery Sustain Circuit for the AC Plasma Display", May 12, 1987, SID International Symposium Digest of Technical Papers, New Orleans, May 12-14, 1987, New York, Palisades Inst. for Research, pp. 92-95, XP000608669.

* cited by examiner

*Primary Examiner*—Richard Hjerpe
*Assistant Examiner*—Leonid Shapiro
(74) *Attorney, Agent, or Firm*—Staas & Halsey LLP

(57) ABSTRACT

A low-cost capacitive load drive circuit, in which a reference voltage, a first voltage, and a second voltage are supplied to a capacitive load, and a plasma display apparatus using it, have been disclosed. The capacitive load drive circuit comprises a reference voltage switch the breakdown voltage of which is properly adjusted, a first switch, a reference voltage phase adjusting circuit, and a first phase adjusting circuit, and malfunctions due to the difference in switching characteristics can be prevented from occurring even when devices of different breakdown voltages are used.

8 Claims, 26 Drawing Sheets

CAPACITIVE LOAD DRIVE CIRCUIT AND PLASMA DISPLAY APPARATUS

BACKGROUND OF THE INVENTION

The present invention relates to a capacitive load drive circuit used as a drive circuit for sustain electrodes and scan electrodes of a plasma display apparatus and to a plasma display apparatus that comprises a capacitive load drive circuit used as a drive circuit of sustain electrodes and scan electrodes.

The plasma display apparatus has been put to practical use as a flat display and is a thin display with high luminance. FIG. 1 is a diagram that shows the general structure of a conventional three-electrode AC-driven plasma display apparatus. As shown schematically, the plasma display apparatus comprises a plasma display panel (PDP) 1 composed of two substrates, between which a discharge gas is sealed, each substrate having plural X electrodes (X1, X2, X3, . . . , Xn) and Y electrodes (Y1, Y2, Y3, . . . , Yn) arranged adjacently by turns, plural address electrodes (A1, A2, A3, . . . , Am) arranged in the direction perpendicular thereto, and phosphors arranged at crossings, an address driver 2 that applies an address pulse to the address electrode, an X common driver 3 that applies a sustain discharge pulse to the X electrode, a scan driver 4 that applies a scan pulse sequentially to the Y electrode, a Y common driver 5 that supplies a sustain discharge pulse to be applied to the Y electrode to the scan driver 4, and a control circuit 6 that controls each section, and the control circuit 6 further comprises a display data control section 7 that includes a frame memory and a drive control circuit 8 composed of a scan driver control section 9 and a common driver control section 10. The X electrode is also referred to as the sustain electrode and the Y electrode is also referred to as the scan electrode. As the plasma display apparatus is widely known, a more detailed description of the entire apparatus is not given here and only the X common driver 3 and the Y common driver 5 that relate to the present invention are further described. The X common driver, the scan driver and the Y common driver of the plasma display apparatus have been disclosed, for example, in Japanese Patent No. 3201603, Japanese Unexamined Patent Publication (Kokai) No. 9-68946 and Japanese Unexamined Patent Publication (Kokai) No. 2000-194316.

FIG. 2 is a diagram that shows an example of the structure of the X common driver, the scan driver and the Y common driver, which have been disclosed as described above. The plural X electrodes are connected commonly and driven by the X common driver 3. The X common driver 3 comprises output devices (transistors) Q8, Q9, Q10 and Q11, which are provided between the common X electrode terminal and a voltage source +Vs1, between that and −Vs2, between that and +Vx, and between that and the ground (GND), respectively. By turning on any one of the transistors, the corresponding voltage is supplied to the common X electrode terminal.

The scan driver 4 is composed of individual drivers provided for each Y electrode and each individual driver comprises transistors Q1 and Q2, and diodes D1 and D2 provided in parallel thereto, respectively. Each of one end of transistors Q1 and Q2, and diodes D1 and D2 of each individual driver is connected to each Y electrode and each of the other end is connected commonly to the Y common driver 5. The Y common driver 5 comprises transistors Q3, Q4, Q5, Q6 and Q7, which are provided between the lines from the scan driver 4 and the voltage sources +Vs1, −Vs2, +Vwy, +Vy, and the ground (GND), respectively, and the transistors Q3, Q5, and Q7 are connected to the transistor Q1 and the diode D1, and the transistors Q4 and Q6, to the transistor Q2 and the diode D2.

In a reset period, Q5 and Q11 are turned on while the other transistors are being kept off, and +Vwy is applied to the Y electrode and 0V is applied to the X electrode to generate an entire write/erase pulse that brings the display cells in the panel 1 into a uniform state. At this time, the voltage +Vwy is applied to the Y electrode via Q5 and D1. In an address period, Q6, Q7, and Q10 are turned on while the other transistors are being kept off, and +Vx is applied to the X electrode, the voltage GND, to the terminal of Q2, and −Vy is applied to the terminal of Q1. In this state, a scan pulse that turns Q1 on and turns Q2 off is applied sequentially to the individual drivers. At this time, in individual drives to which a scan pulse is not applied, Q1 is turned off and Q2 is turned on, therefore, −Vy is applied to the Y electrode, to which the scan pulse is applied, via Q1, GND is applied to the other Y electrodes via Q2, and an address discharge is caused to occur between the address electrode to which a positive data voltage is applied and the Y electrode to which the scan pulse is applied. In this way, each cell in the panel is put into a state according to the display data.

In a sustain discharge period, while Q1, Q2, Q5 to Q7, Q10 and Q11 are being kept off, Q3 and Q9, and Q4 and Q8 are alternately turned on. These transistors are called the sustain transistors, wherein Q3 and Q8 that are connected to a high potential side power source are called the high-side switches, and Q4 and Q9 that are connected to a low potential side power source are called the low-side switches here. In this way, +Vs1 and −Vs2 are alternately applied to the Y electrode and the X electrode and a sustain discharge is caused to occur in the cell in which an address discharge has been caused to occur in the address period and the display is performed. At this time, if Q3 is turned on, +Vs1 is applied to the Y electrode via D1, and if Q4 is turned on, −Vs2 is applied to the Y electrode via D2. In other words, the voltage Vs1+Vs2 is alternately applied to the X electrode and the Y electrode, with a reversed polarity, in the sustain discharge period. This voltage is called the sustain voltage here.

The example described above is only one of various examples, and there are various modifications as to which kind of voltage is applied in the reset period, the address period, and the sustain discharge period, and there are also various modifications of the scan driver 4, the Y common driver 5 and the X common driver 6. Particularly in the drive circuit described above, +Vs1 and −Vs2 are applied alternately to the Y electrode and the X electrode to apply the sustain voltage of Vs1+Vs2=Vs, but there is another method in which Vs and GND are applied alternately and it is widely used.

In the general plasma display apparatus, the voltage Vs is set to a value between 150V and 200V, and the drive circuit is made up of transistors of large voltage rating (breakdown voltage). Contrary to this, in the driving method disclosed in such as Japanese Patent 3201603, Japanese Unexamined Patent Publication (Kokai) No. 9-68946 and Japanese Unexamined Patent Publication (Kokai) No. 2000-194316, the positive and negative sustain voltages (+Vs/2 and −Vs/2) are applied alternately to the X electrode and the Y electrode. This has an advantage in that it will be possible to reduce the breakdown voltage of the smoothing capacitor of the power source that supplies the sustain voltage.

The scan pulse must be applied sequentially to each Y electrode, therefore, Q1 and Q2, that relate to the application of the scan pulse, are required to be capable of high-speed operations. Moreover, as the number of times a sustain discharge is caused to occur affects the display luminance and as many sustain discharges as possible must be caused to occur in a fixed period, the sustain transistors Q3, Q4, Q8, and Q9, which relate to the application of the sustain discharge pulse, are also required to be capable of high-speed operations. On the other hand, in the plasma display apparatus, it is necessary to apply a high voltage to each electrode in order to cause a discharge to occur, therefore, the transistors are required to have a high breakdown voltage. A transistor which has a high breakdown voltage but has a relatively low operating speed, or a transistor which has a high operating speed but has a relatively low breakdown voltage, can be manufactured at a low cost, but a transistor which has not only a high breakdown voltage but also a high operating speed is costly.

Among the transistors in FIG. 2, the operating speed of Q6, Q7, Q10 and Q11 can be relatively low because they do not directly relate to the application of the scan pulse and the sustain discharge pulse, which requires a high-speed operation. Although a high-speed operation is required for Q1 and Q2, their breakdown voltages can be relatively small, because D1 and D2 are provided in parallel thereto, the voltages to be applied are −Vy and GND, and the difference in voltage therebetween is relatively small.

Contrary to this, the sustain transistors Q3, Q4, Q8, and Q9 need to be capable of high-speed operations and a high voltage is applied thereto as well. Among the applied voltages in the circuit in FIG. 2, the largest is the reset voltage +Vwy and the smallest one is −Vs2. When Q5 is turned on and the reset voltage +Vwy is applied, therefore, the voltage Vwy+Vs2 is applied to the sustain transistor Q4, as a result. Normally, −Vy is greater than −Vs2 (the absolute value is less) and +Vx is less than +Vs1. The maximum voltage to be applied to other sustain transistors Q3, Q8 and Q9 is Vs1+Vs2, which is less than the voltage Vwy+Vs2 to be applied to Q4.

As described above, there are various modification examples of the voltage to be supplied from the drive circuit of the plasma display apparatus, therefore, the maximum voltage to be applied to each sustain transistor differs from another accordingly. In general, when a voltage greater than the sustain voltage on the high potential side is applied, the maximum voltage to be applied to the sustain transistors that make up the low-side switch is greater than the sustain voltage, and when a voltage less than the sustain voltage on the low potential side is applied, the maximum voltage to be applied to the sustain transistors that make up the high-side switch is greater than the sustain voltage.

In the conventional apparatus, sustain transistors of the same breakdown voltage (voltage rating) are selected despite the difference in the maximum voltage to be applied, as described above. In other words, the devices are selected so that their breakdown voltages correspond to that of the sustain transistor that receives the maximum voltage, and other sustain transistors are selected from those of the same breakdown voltage. This means that different kinds or sizes of transistors are selected when devices of different breakdown voltages are selected and, as a result, the switching performance of each transistor is different. Moreover, a device of a high breakdown voltage has a high saturation voltage and a circuit structure is required in which plural devices are driven in parallel in order to lower the saturation voltage. If, therefore, sustain transistors of different breakdown voltages are used, the switching performance of each sustain transistor differs from another and a problem is caused in that they cannot be turned on/off stably. In the sustain (sustain discharge) action, charges are moved from one electrode to the other and the timing of the application of the sustain voltage is important and, therefore, a problem that the sustain action is terminated is caused if the timing is not correct.

For the above-mentioned reasons, a capacitive additional drive circuit, such as that of the sustain electrode and that of the scan electrode of the plasma display apparatus, is not configured by combining drive transistors (output devices) of different breakdown voltages.

On the other hand, in the conventional plasma display apparatus, the sustain voltage is supplied by applying GND to one of the electrodes but a structure in which the breakdown voltage of the smoothing capacitor of the power source, that supplies the sustain voltage, can be lowered by applying the positive and the negative voltages alternately to the X electrode and the Y electrode as described above, has been disclosed in Japanese Patent No. 3201603, Japanese Unexamined Patent Publication (Kokai) No. 9-68946 and Japanese Unexamined Patent Publication (Kokai) No. 2000-194316. In order to apply the sustain voltage in the way described above, a compact power source circuit that can stably supply positive and negative voltages with high precision is required.

SUMMARY OF THE INVENTION

The first objective of the present invention is to realize a capacitive load drive circuit of a low cost by using proper sustain transistors, and the second objective is to realize a plasma display apparatus of high reliability that performs the application of positive and negative sustain voltages.

The capacitive load drive circuit in the first aspect of the present invention is one that supplies a reference voltage, a first voltage and a second voltage to a capacitive load and, when the difference in voltage between the reference voltage and the second voltage is larger than that between the first voltage and the second voltage, the voltage rating of a first switch that supplies the first voltage is selected so as to be less (a lower breakdown voltage) than that of a reference voltage switch that supplies the reference voltage, and when the difference in voltage between the first voltage and the second voltage is larger than that between the reference voltage and the second voltage, the voltage rating of the reference voltage switch is selected so as to be less than that of the first switch. Then, a reference voltage phase adjusting circuit that adjusts the phase of a drive pulse that drives the reference voltage switch and a first phase adjusting circuit that adjusts the phase of a drive pulse that drives the first switch are provided, and it is arranged that the timings of both the switches can be adjusted precisely. In this way, even if devices (transistors) of different breakdown voltages are used, occurrence of malfunctions caused by the difference in switching characteristic due to different breakdown voltages can be prevented and the number of parallel devices in a switch can be reduced and the sizes of the transistor chips can be reduced.

For simplicity, an example case is described on the assumption that the first voltage is greater than the reference voltage, the second voltage is greater than the first voltage, and the maximum voltage to be applied to the reference voltage switch is greater than that to be applied to the first switch, but it is needless to say that the case where the maximum voltage to be applied to the first switch is greater than that to be applied to the reference voltage switch is also applicable in a reverse manner.

The second voltage is supplied to the capacitive load through the first switch or directly. When the second voltage is supplied through the first switch, it is supplied to the first switch via a fifth switch and a second diode but, in this case, the first switch is driven so as to be on while the fifth switch is on in order to prevent the differential voltage between the low potential reference voltage and the second voltage from being applied to the first switch.

When the second voltage is directly supplied to the capacitive load, a protective diode is provided between the capacitive load and the first switch.

In order to reduce the drive power, a third voltage between the low potential reference voltage and the first voltage is provided, and when the voltage to be supplied to the capacitive load is changed from the low potential reference voltage to the first voltage, the third voltage is temporarily supplied to the capacitive load via a third switch, and when the voltage to be supplied to the capacitive load is changed from the first voltage to the low potential reference voltage, the third voltage is temporarily supplied to the capacitive load via a fourth switch but, in this case, a third phase adjusting circuit that adjusts the phase of a drive pulse that drives the third switch and a fourth phase adjusting circuit that adjusts the phase of the drive pulse that drives the fourth switch are provided and the voltage rating of the third switch is made less than that of the fourth switch.

In addition, if the terminals of the third and fourth switches are connected to the capacitive load via inductances, a power recovery path relating to the supply of the low potential reference voltage and the first voltage to the capacitive load can be configured.

Although it is needless to say that both the reference voltage switch and the first switch can be configured by power MOSFETs or insulated gate bipolar transistors, according to the present invention, it is also possible to configure the first switch of a low breakdown voltage by power MOSFETs and the reference voltage switch of a high breakdown voltage by insulated gate bipolar transistors.

When it is set so that the low potential reference voltage is a negative voltage and the intermediate potential between the low potential reference voltage and the first voltage is GND, it can be a case where the X electrode and the Y electrode are set to GND. In this case, if the third voltage is set to GND in the configuration in which the third and fourth switches are provided, it is possible to set the X electrode and the Y electrode to GND by utilizing the third and fourth switches and it is not necessary to provide another switch to set the X electrode and the Y electrode to GND.

If the above-mentioned capacitive load drive circuit is used as an X common driver or a Y common driver in a plasma display apparatus, a compact plasma display apparatus of high reliability can be realized.

In the plasma display apparatus, when the low potential reference voltage is a negative one, a power source circuit to generate the first positive voltage and a negative voltage is required and the first positive voltage and the negative voltage need to be generated with high precision. The power source circuit is, therefore, configured by a first voltage circuit that generates the first voltage with high precision and a negative voltage circuit that generates the negative voltage with high precision, each monitoring the generated voltages to keep the voltage values stable.

It is also possible to configure so that the negative voltage is generated from the first positive voltage.

It is also possible to generate the first voltage and the negative voltage with high precision by using a power source circuit that has a transformer, rectifying the current taken from the secondary side of the transformer to generate the first voltage and the negative voltage, and detecting the voltage value of one of them to control the switch that controls the current supply to the primary side of the transformer.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 3:
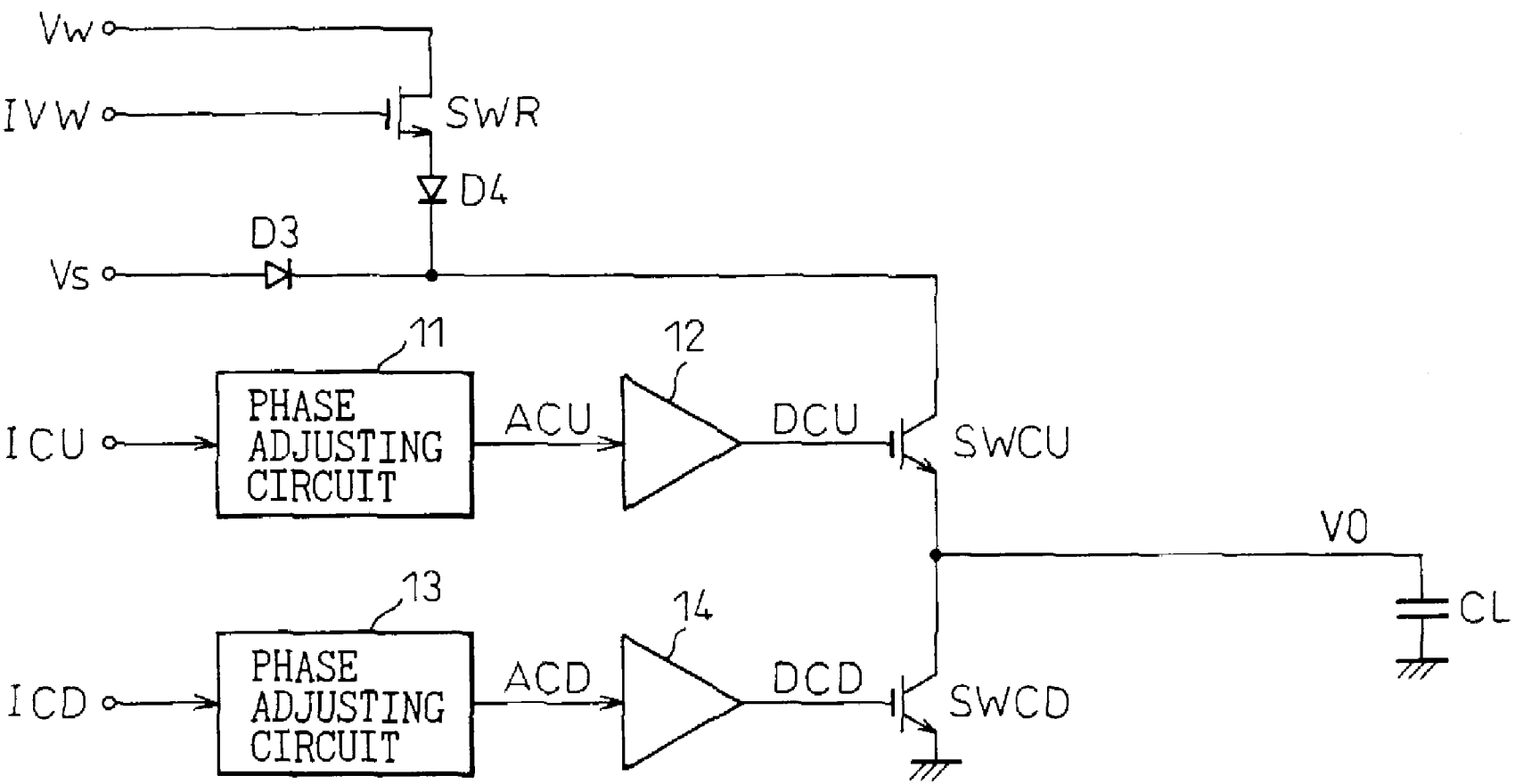
FIG. 3 is a diagram that shows the structure of the capacitive load drive circuit in the first embodiment of the present invention.

FIG. 3 is a diagram that shows the structure of the capacitive load drive circuit in the first embodiment of the present invention. As shown schematically, one end of capacitive load CL is connected to the ground GND and the capacitive load drive circuit supplies voltage V0 to the other end of the capacitive load CL. The supplied voltage V0 is the low potential reference voltage GND, the positive voltage Vs, which is the first voltage, and the second voltage Vw, which is greater than the first voltage Vs.

In the capacitive load drive circuit in the first embodiment, a transistor SWCU that makes up the first switch and a transistor SWCD that makes up the second switch are connected in series, and the connection point of SWCU and SWCD is connected to CL. One end of SWCU is connected to the power source that supplies Vs via a diode D3 and is simultaneously connected to the power source that supplies Vw via a transistor SWR that makes up the fifth switch. The other end of SWCD is connected to GND. A control signal ICU of SWCU is phase-adjusted into a signal ACU in a phase adjusting circuit 11 and is applied to the gate of SWCU after amplified in an amplification circuit 12. Similarly, a control signal ICD of SWCD is phase-adjusted into a signal ACD in a phase adjusting circuit 13 and is applied to the gate of SWCD after amplified in an amplification circuit 14. A control signal IVW is applied to the gate of SWR.

The capacitive load drive circuit in the first embodiment is characterized in that the transistor SWCU that makes up the first switch is composed of a low breakdown voltage (low voltage rating) device, the transistor SWCD that makes up the second switch is composed of a high breakdown voltage (high voltage rating) device, and the drive signals ICU and ICD are phase-adjusted and applied to the gates of SWCU and SWCD. Concretely speaking, the voltage rating of SWCD is specified on the assumption that the high voltage Vw is applied as the maximum voltage and that of SWCU is specified on the assumption that the voltage Vs is applied as the maximum voltage. SWCU and SWCD are composed of insulated gate bipolar transistors here. The operations of the capacitive load drive circuit in the first embodiment are described below.

In this circuit, in a state in which the transistor SWCD is off, the transistor SWCU is turned on to supply the first voltage Vs to the capacitive load CL. On the other hand, in a state in which SWCU is off, SWCD is turned on to lower the voltage V0 applied to the capacitive load CL to GND. In addition, in a state in which SWCD is off and SWCU is on, SWR is turned on to supply the second voltage Vw to the capacitive load CL. When the second voltage Vw is supplied to the capacitive load CL, the diode D3 is turned off and a diode D4 is turned on.

In this circuit, while the second voltage Vw is being supplied to the capacitive load CL, the voltage Vw is applied to the transistor SWCD. SWCD is, therefore, composed of a high breakdown voltage device. Contrary to this, SWCU uses a low breakdown voltage device, therefore, it is necessary to prevent Vw from being applied to SWCU. For example, when the voltage V0 applied to the capacitive load CL is GND, there is a possibility that the high voltage Vw is applied to SWCU in the initial stage during the period of transition of SWCU from off state to on state, if SWR is turned on first and then SWCU is turned on. The voltage rating of SWCU is, however, specified on the assumption that the voltage Vs is applied as the maximum voltage, and there is a possibility that SWCU is destroyed if the high voltage Vw is applied. In order to avoid this, the capacitive load drive circuit in the first embodiment is controlled so that SWCU is on without fail while SWR is on. Concretely speaking, the timing is designed so that SWR is turned on after SWCU is turned on and SWCU is turned off after SWR is turned off.

The diode 3 serves to prevent a short circuit between the power source for the voltage Vw and that for the voltage Vs when SWR is turned on. The diode 4 serves to prevent the current from flowing back to SWR when the voltage Vw is less than the voltage Vs, such as at start-up.

Figure 4:
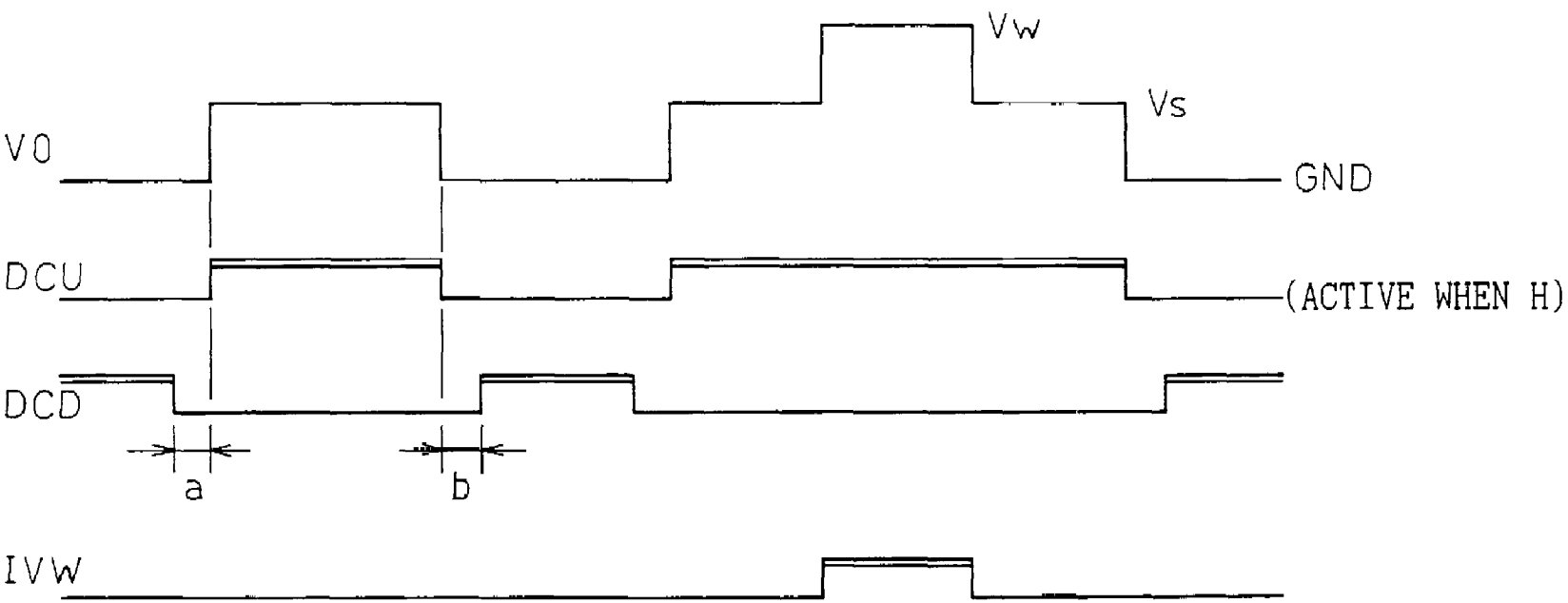
FIG. 4 is a diagram that shows the drive waveforms in the first embodiment.

FIG. 4 is a diagram that shows the drive waveforms in the capacitive load drive circuit in the first embodiment. As shown schematically, when SWR is turned on and the voltage Vw is applied, SWCU is also turned on. Moreover, as a low breakdown voltage device is used for SWCU and a high breakdown voltage device is used for SWCD in this capacitive load drive circuit, the switching characteristics are not necessarily the same. The phase adjusting circuits 11 and 13 are, therefore, provided in order to stabilize the circuit operations. The phase adjusting circuits 11 and 13 adjust the amount of delay at the leading edge and that at the falling edge of the control signals ICU and ICD. As a result, it is possible to properly specify time margins (periods during which both SWCU and SWCD are off) a and b and stable operations can be realized.

On the other hand, when a phase adjusting circuit is not used, it is necessary to select SWCU (low breakdown voltage part) and SWCD (high breakdown voltage part) of similar switching characteristics or take into consideration the difference in the switching characteristic when designing the control signals ICU and ICD for stable operations.

Figure 5:
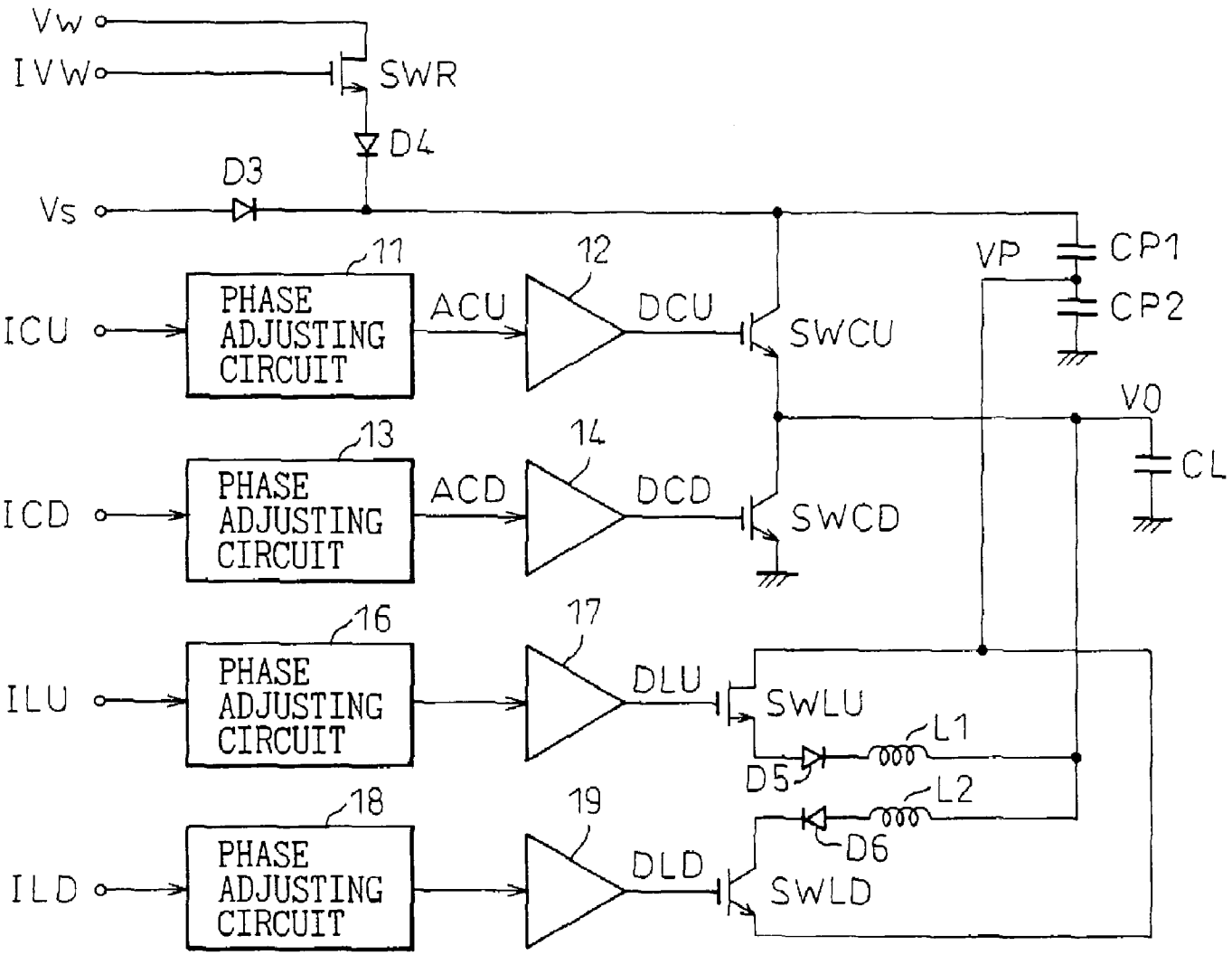
FIG. 5 is a diagram that shows the structure of the capacitive load drive circuit in the second embodiment of the present invention.

FIG. 5 is a diagram that shows the structure of the capacitive load drive circuit in the second embodiment of the present invention. The capacitive load drive circuit in the second embodiment is a modified circuit of the capacitive load drive circuit in the first embodiment by providing a power loss suppression/power recovery circuit thereto. In the power loss suppression/power recovery circuit, a voltage Vp is formed by capacitors CP1 and CP2 connected directly between the terminal of SWCU and GND. The voltage Vp is a voltage between the voltage Vs and GND, and the capacitances of CP1 and CP2 are the same and Vp is Vs/2. One end of a transistor SWLU is connected to CL via an inductance device L1 and a diode 5, and the other end is connected to the connection point of CP1 and CP2. After being phase-adjusted in a phase adjusting circuit 16, a control signal ILU of SWLU is amplified in an amplification circuit 17 and applied to the gate of SWLU. After phase-adjusted in a phase adjusting circuit 18, a control signal ILD of SWLD is amplified in an amplification circuit 19 and applied to the gate of SWLD.

Figure 6:
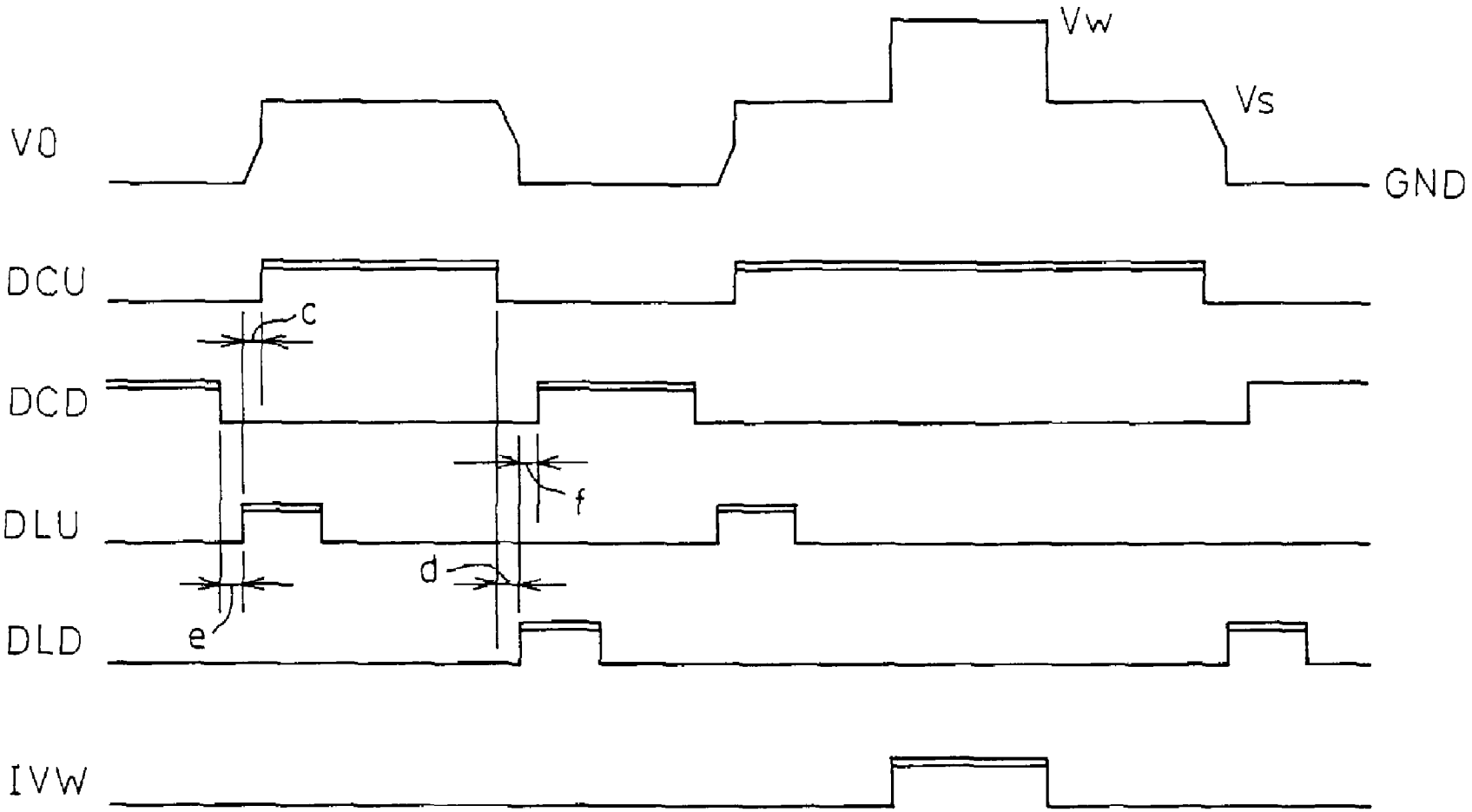
FIG. 6 is a diagram that shows the drive waveforms in the second embodiment.

FIG. 6 is a diagram that shows the drive waveforms in the capacitive load drive circuit in the second embodiment. As shown schematically, drive signals DCU and DCD of SWCU and SWCD have the same waveforms as those in the first embodiment. In the second embodiment, SWLU is turned on just before the SWCU is turned on and the charges accumulated in the capacitors CP1 and CP2 are supplied to the capacitive load CL via the inductance device L1 and the diode D5. SWLD is turned on just before SWCD is turned on and the charges accumulated in the capacitive load CL are supplied to the capacitors CP1 and CP2 via the inductance device L2 and the diode D6. In this way, by carrying out the supply and the recovery of charges to/from the capacitive load CL via the inductance devices L1 and L2, the power loss of SWCU and SWCD can be reduced. In this case, it is possible to form, in principle, a lossless capacitive load drive circuit because the resonance of the LC circuit can be utilized.

In the capacitive load drive circuit in the second embodiment, when the voltage V0, which is supplied to the capacitive load CL, is changed between Vs and GND, it is temporarily changed to the intermediate voltage Vp and then changed to the target voltage, therefore, the amount of change in power is suppressed and the effect that power loss can be suppressed without using the inductance devices L1 and L2 can be obtained.

For example, let P1 be the power consumption of the circuit without SWLU and SWLD in the first embodiment, P1 is expressed as follows.

$$P1=CL\times Vs\times Vs/2,$$

where CL is the capacitance of the capacitive load.

Moreover, let P2 be the power consumption of the circuit with SWLU and SWLD in the second embodiment, P2 is expressed as follows.

$$P2=CL\times Vp\times Vp/2+C1\times(Vs-Vp)\times(Vs-Vp)/2.$$

If $Vp=Vs/2$, then, $$P2=CL\times Vs\times Vs/4=P1/2.$$

This means that it is possible, in principle, to halve the power consumption without using the inductance devices L1 and L2.

In the circuit in the second embodiment, even when the voltage Vw is applied to the capacitive load, the voltage can be prevented from being applied to SWLU by means of the diode D5, therefore, SWLD needs to be realized by a high breakdown voltage device but SWLU can be configured by a lower breakdown voltage device compared to SWLD. SWLD is configured by an IGBT and SWLU is configured by a MOS transistor.

When the breakdown voltage of SWLU is different from that of SWLD, it is necessary to realize stable operations by providing the phase adjusting circuits 16 and 18 to adjust the timing or by designing the control signals ILU and ILD, with the switching characteristics of the devices to be used being into consideration, because the switching characteristics are not necessarily the same. The phase adjusting circuits 16 and 18 adjust the amount of delay at the leading edge and that at the falling edge of the control signals ILU and ILD. As a result, it is possible to properly specify time margins (periods during which both SWCU and SWCD are off) c, d, e and f as shown in FIG. 6 and stable operations can be realized.

Although the low potential side reference voltage is set to the ground GND in the first and the second embodiments, the low potential side reference voltage can be set to the negative voltage −Vs. The third and the fourth embodiments are those in which the low potential reference voltage is set to the negative voltage −Vs.

Figure 7:
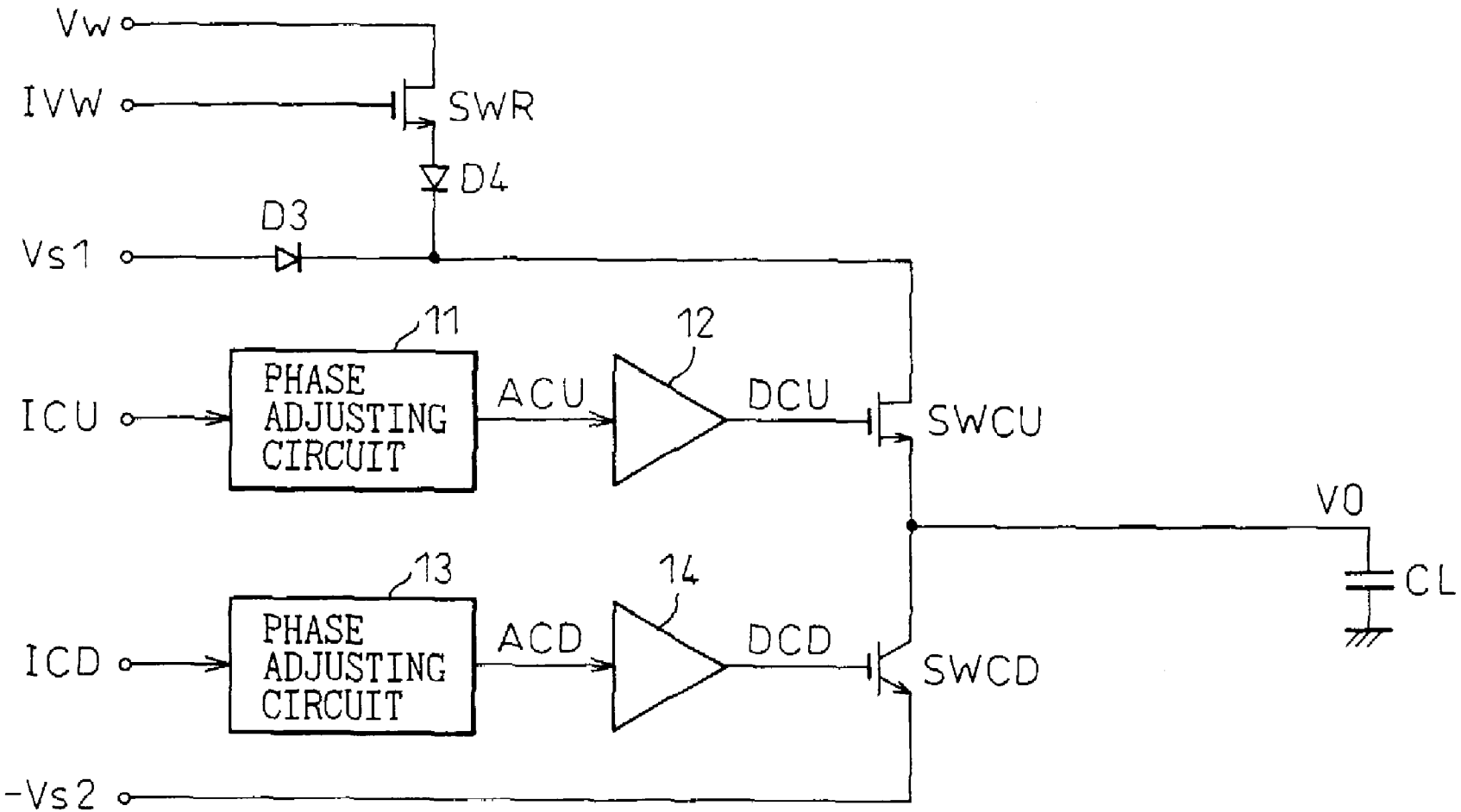
FIG. 7 is a diagram that shows the structure of the capacitive load drive circuit in the third embodiment of the present invention.

FIG. 7 is a diagram that shows the structure of the capacitive load drive circuit in the third embodiment of the present invention. This circuit differs from that in the first embodiment in that one end of the transistor SWCD is connected to the power source for the voltage −Vs2 and Vs1 is supplied to the diode 3. In this case, the sustain voltage is Vs1+Vs2. SWCU is composed of a low breakdown voltage device and SWCD is composed of a high breakdown voltage device. As the operations are the same as those in the first embodiment, a description is omitted. Here, SWCD is composed of an IGBT and SWCU is composed of a MOS transistor.

Figure 8:
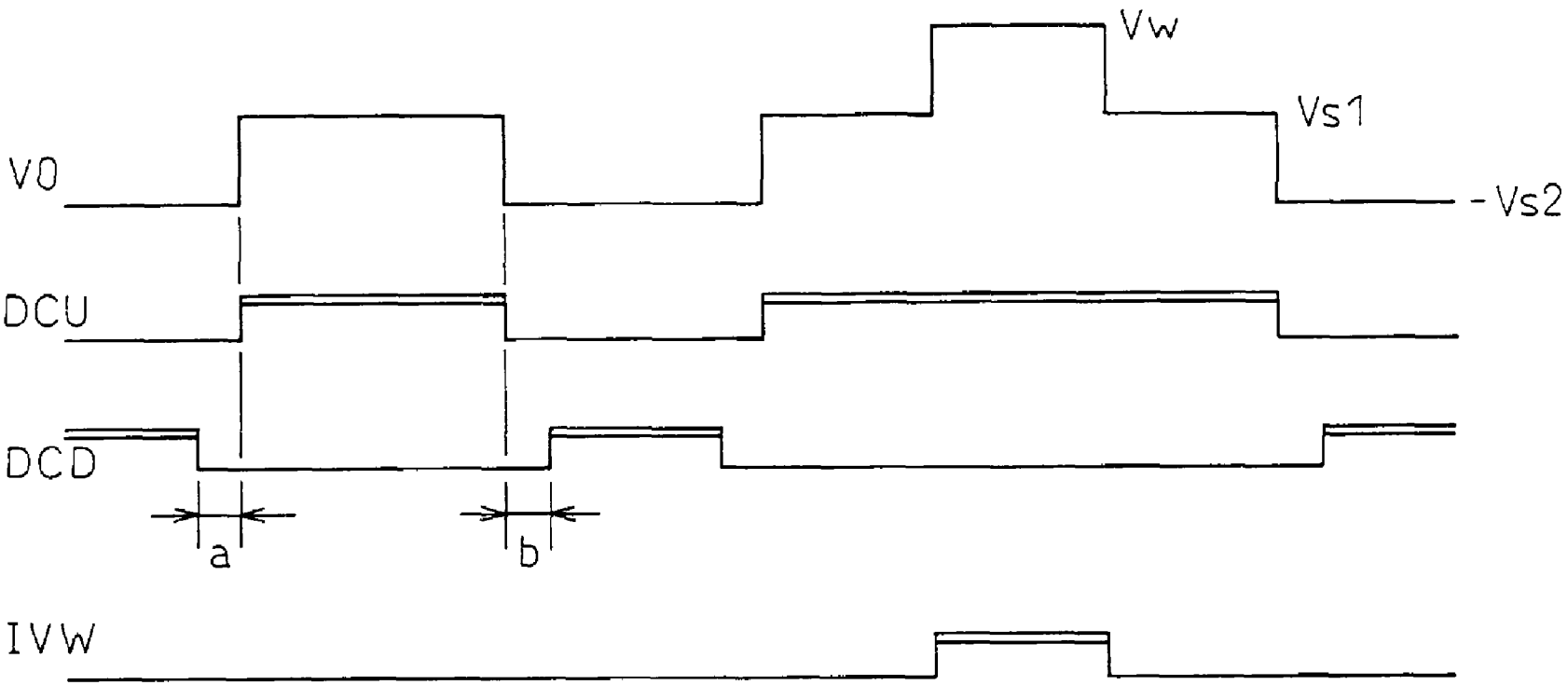
FIG. 8 is a diagram that shows the drive waveforms in the third embodiment.

FIG. 8 is a diagram that shows the drive waveforms in the capacitive load drive circuit in the third embodiment. They differ from those in the first embodiment in that Vs1 and −Vs2 are supplied as V0.

Figure 9:
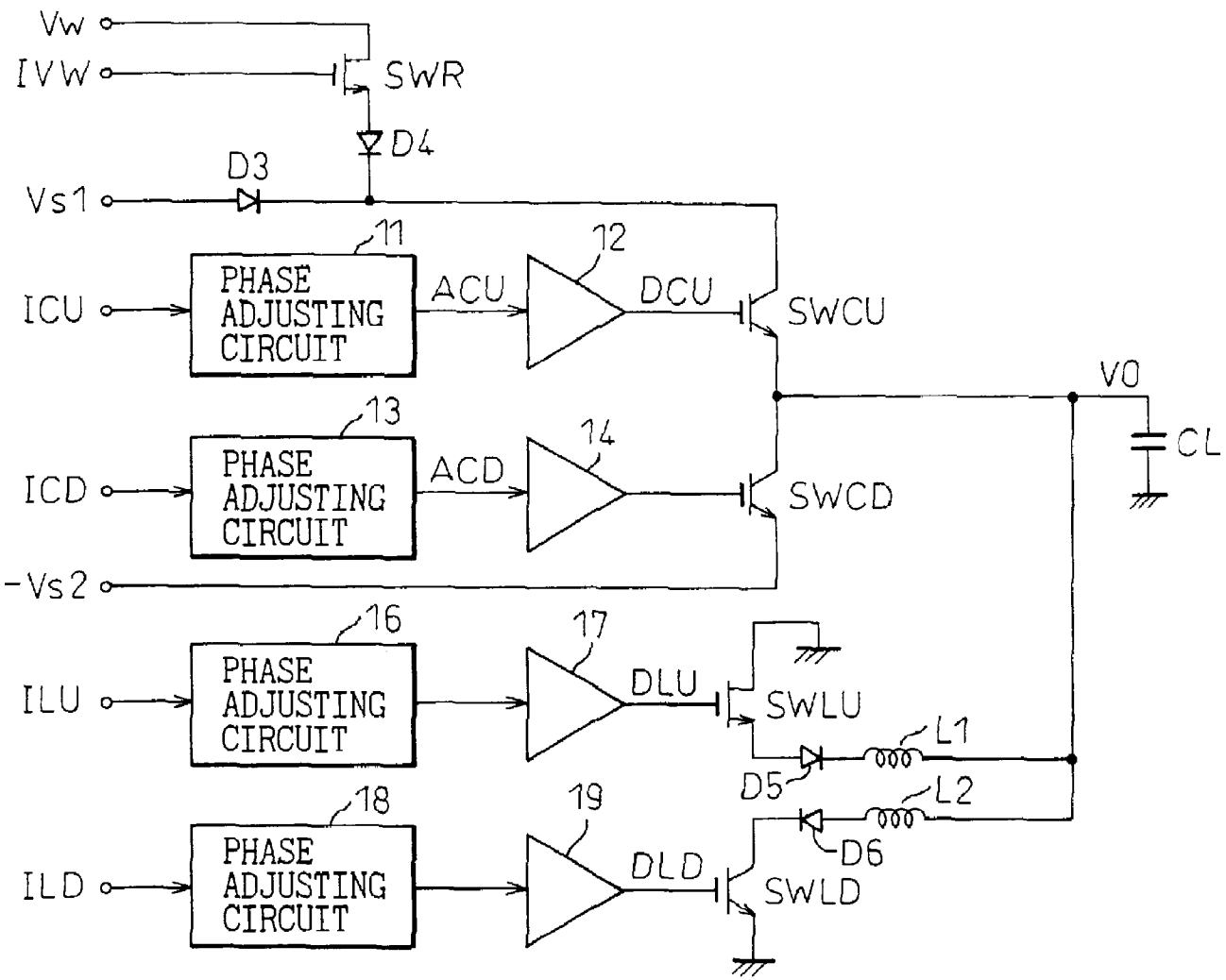
FIG. 9 is a diagram that shows the structure of the capacitive load drive circuit in the fourth embodiment of the present invention.

FIG. 9 is a diagram that shows the structure of the capacitive load drive circuit in the fourth embodiment of the present invention. This circuit differs from that in the second embodiment in that one end of the transistor SWCD is connected to the power source for the voltage −Vs2, Vs1 is supplied to the diode D3, and one end of each SWLU and SWLD is connected to GND. Because of this, the capacitors Cp1 and Cp2 in the second embodiment can be omitted. The sustain voltage is Vs1+Vs2, SWCU is composed of a low breakdown voltage device and SWCD is composed of a high breakdown voltage device. As the operations are the same as those of the second embodiment, a description is omitted.

In a plasma display apparatus in which +Vs1 and −Vs2 (Vs1=Vs2) are supplied alternately to the sustain electrode and the scan electrode during sustain, there may be a case where GND is applied to the sustain electrode and the scan electrode. In the circuit in the fourth embodiment, one end of each SWLU and SWLD is connected to GND and it is possible to apply GND to the capacitive load CL, therefore, if the circuit in the fourth embodiment is used, it is not necessary to provide another circuit to apply GND to the sustain electrode and the scan electrode.

Figure 10:
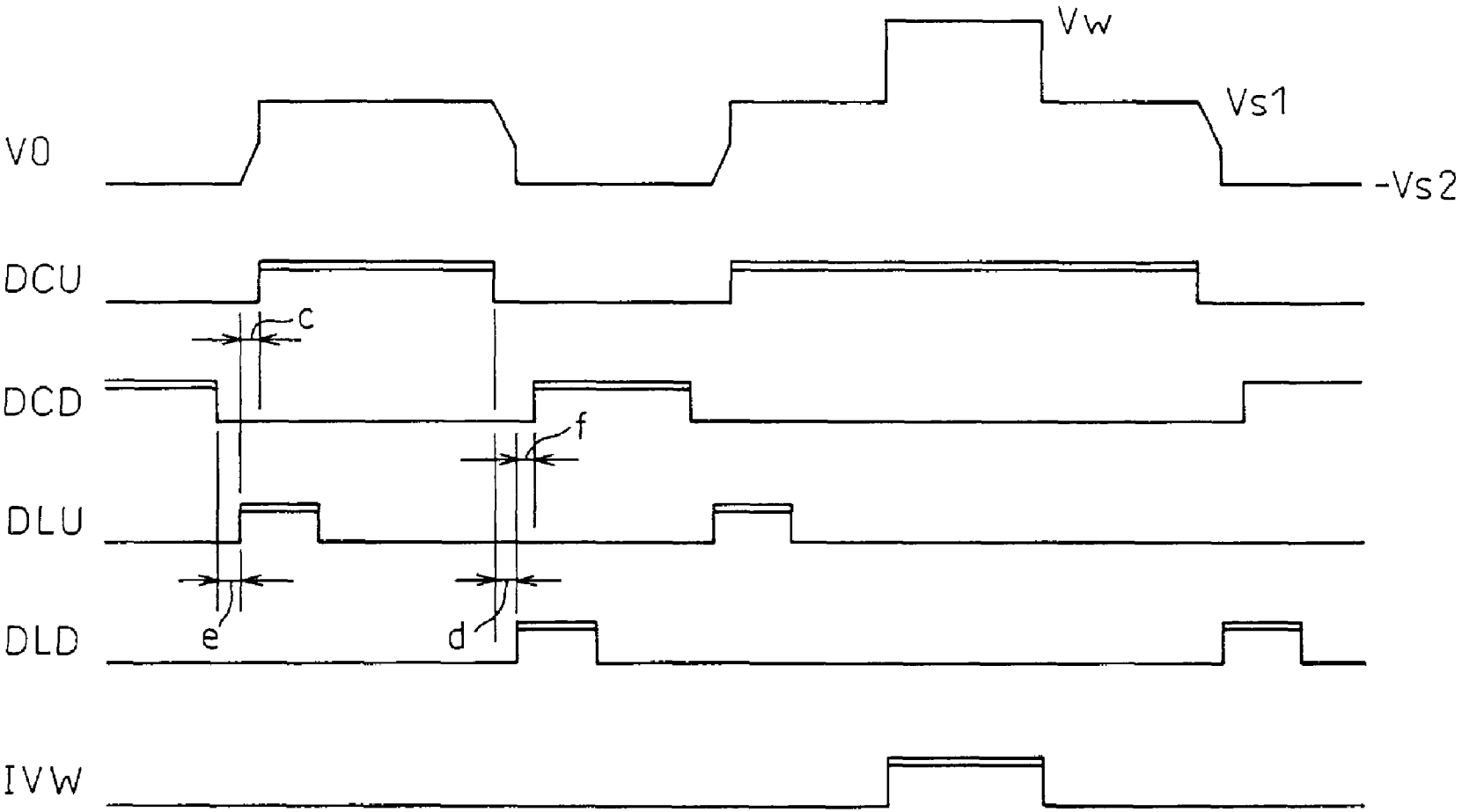
FIG. 10 is a diagram that shows the drive waveforms in the fourth embodiment.

FIG. 10 is a diagram that shows the drive waveforms of the capacitive load drive circuit in the fourth embodiment. They differ from those in the second embodiment in that Vs1 and −Vs2 are supplied as V0.

Although the high voltage Vw is supplied via the transistor SWCU in the first through the fourth embodiments, it is possible to directly supply Vw to the capacitive load CL. The fifth through the eighth embodiments are those in which the present invention is applied to a structure where Vw is supplied directly to the capacitive load CL.

Figure 11:
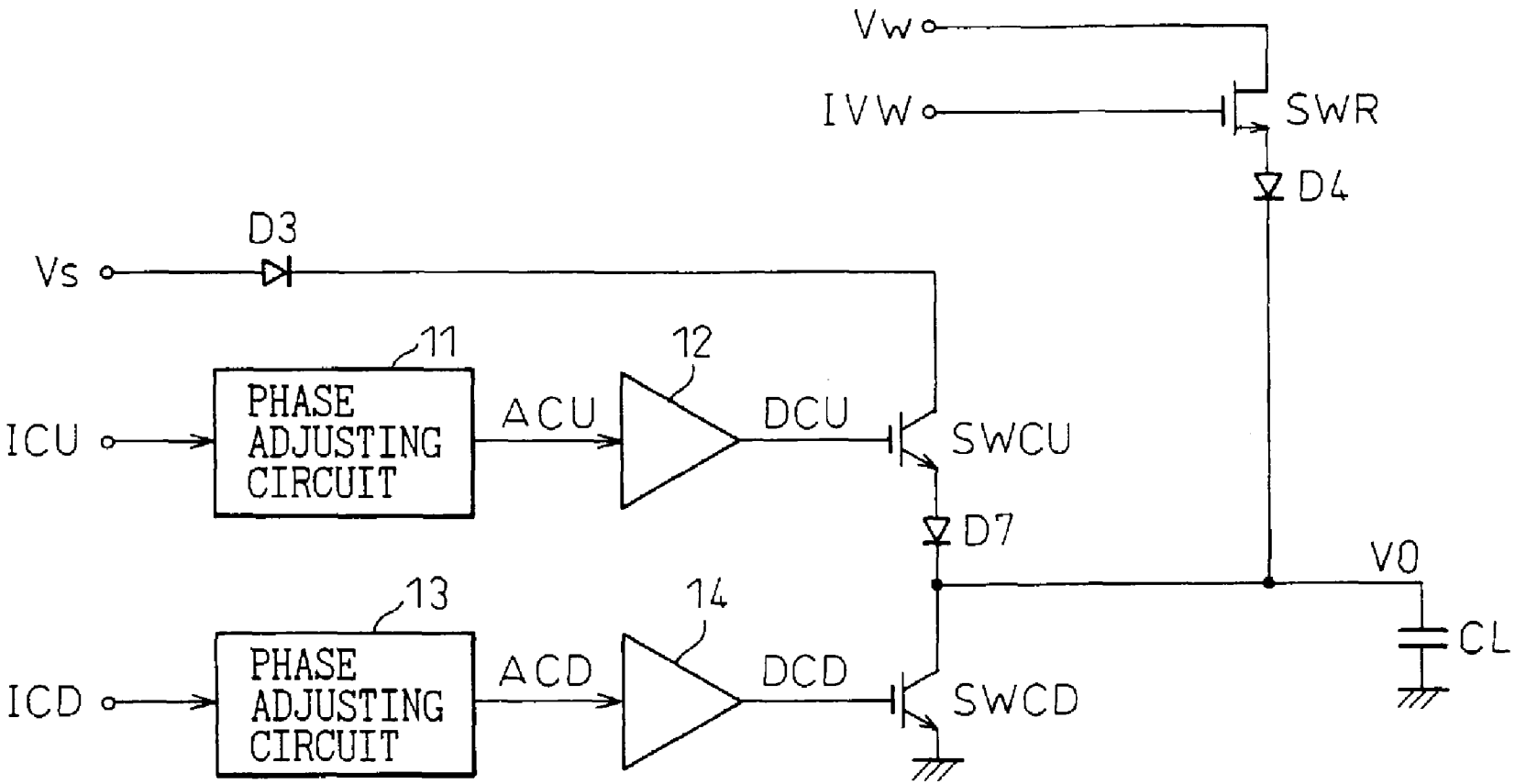
FIG. 11 is a diagram that shows the structure of the capacitive load drive circuit in the fifth embodiment of the present invention.

FIG. 11 is a diagram that shows the structure of the capacitive load drive circuit in the fifth embodiment of the present invention. This circuit differs from that in the first embodiment in that the cathode of the diode D4 is directly connected to the capacitive load CL and SWCU is connected to the capacitive load CL via a diode D7. In this case, the diode 3 can be omitted. In the circuit in the fifth embodiment, the high voltage Vw is not applied to SWCU regardless of the action timings of SWR and SWCU. As the operations are the same as those in the first embodiment, a description is omitted.

Figure 12:
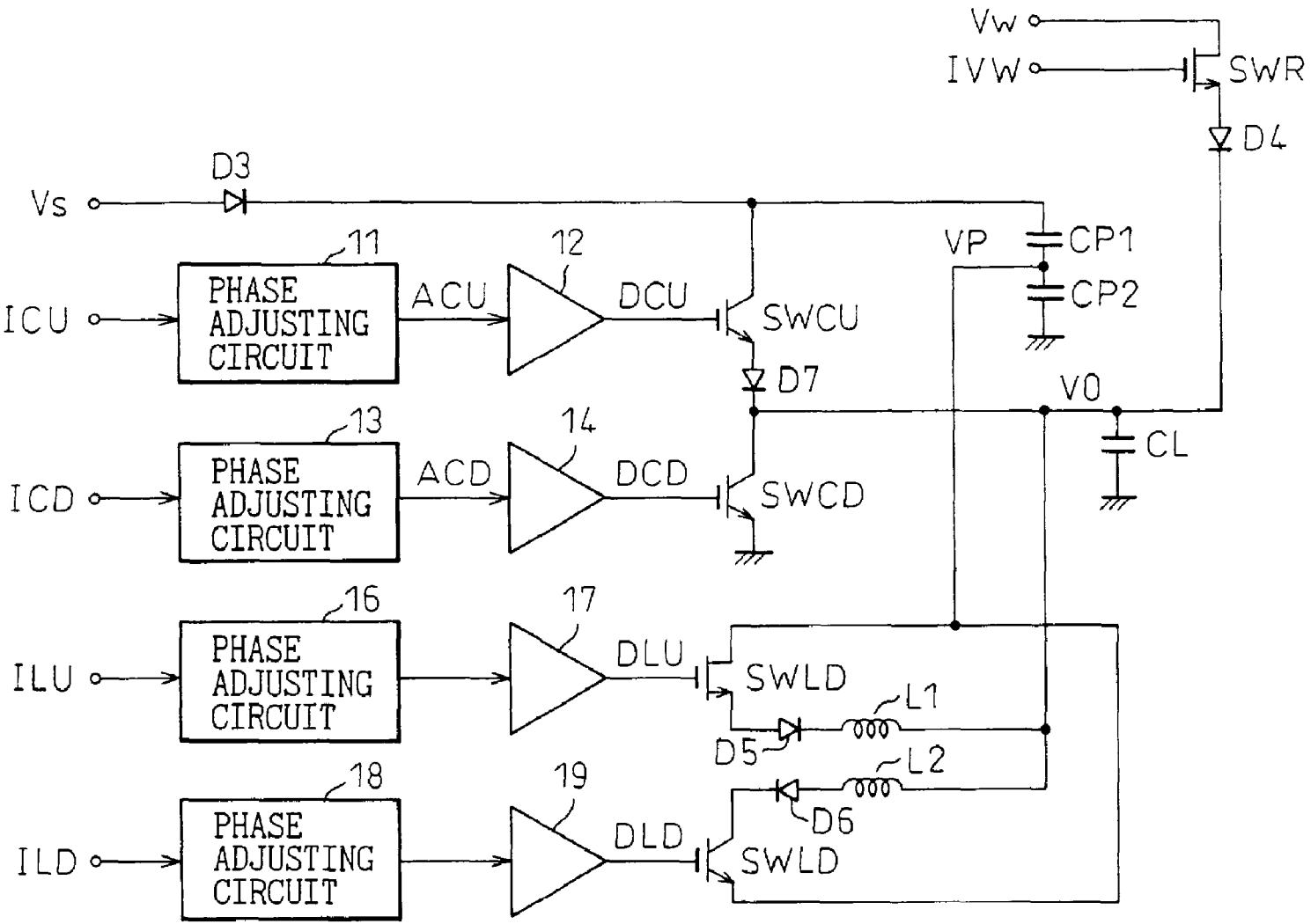
FIG. 12 is a diagram that shows the structure of the capacitive load drive circuit in the sixth embodiment of the present invention.

FIG. 12 is a diagram that shows the structure of the capacitive load circuit in the sixth embodiment of the present invention, and this circuit differs from that in the second embodiment in that the cathode of the diode D4 is directly connected to the capacitive load CL and SWCU is connected to the capacitive load CL via the diode D7.

Figure 13:
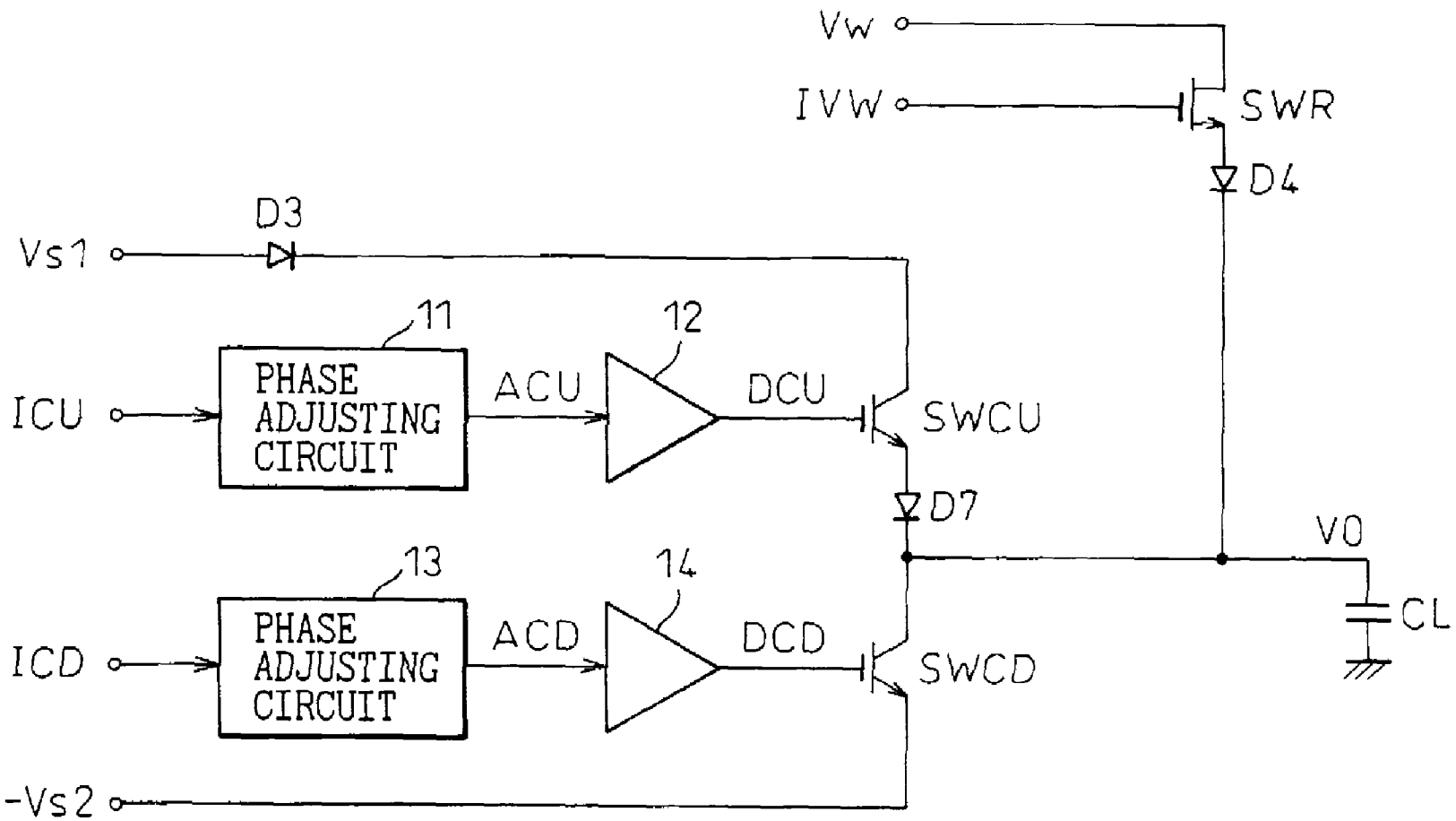
FIG. 13 is a diagram that shows the structure of the capacitive load drive circuit in the seventh embodiment of the present invention.

FIG. 13 is a diagram that shows the capacitive load drive circuit in the seventh embodiment of the present invention, and this circuit differs from that in the third embodiment in that the cathode of the diode D4 is directly connected to the capacitive load CL and SWCU is connected to the capacitive load CL via the diode D7.

Figure 14:
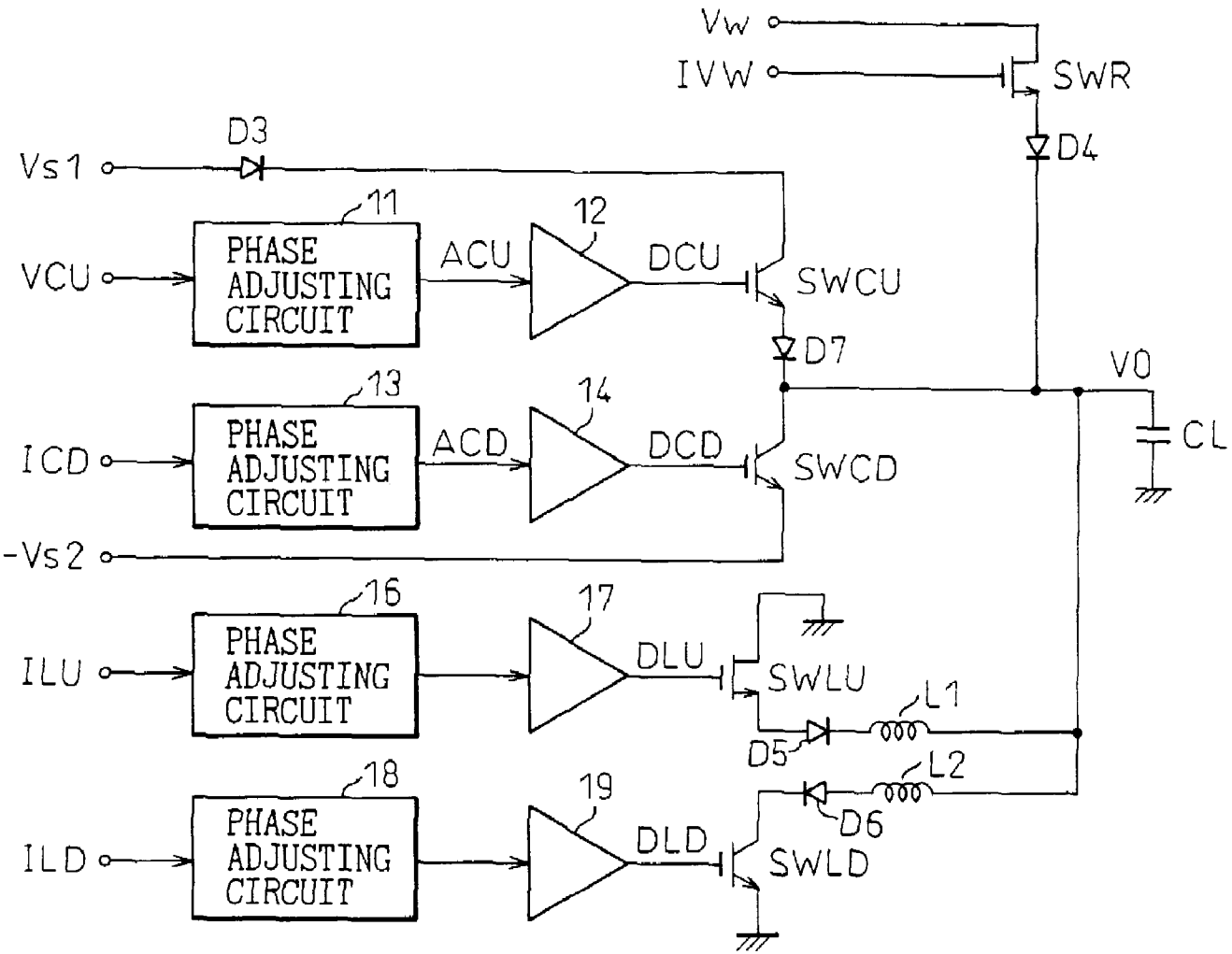
FIG. 14 is a diagram that shows the structure of the capacitive load drive circuit in the eighth embodiment of the present invention.

FIG. 14 is a diagram that shows the structure of the capacitive load drive circuit in the eighth embodiment of the present invention, and this circuit differs from that in the fourth embodiment in that the cathode of the diode D4 is connected directly to the capacitive load CL and SWCU is connected to the capacitive load CL via the diode D7.

Figure 2:
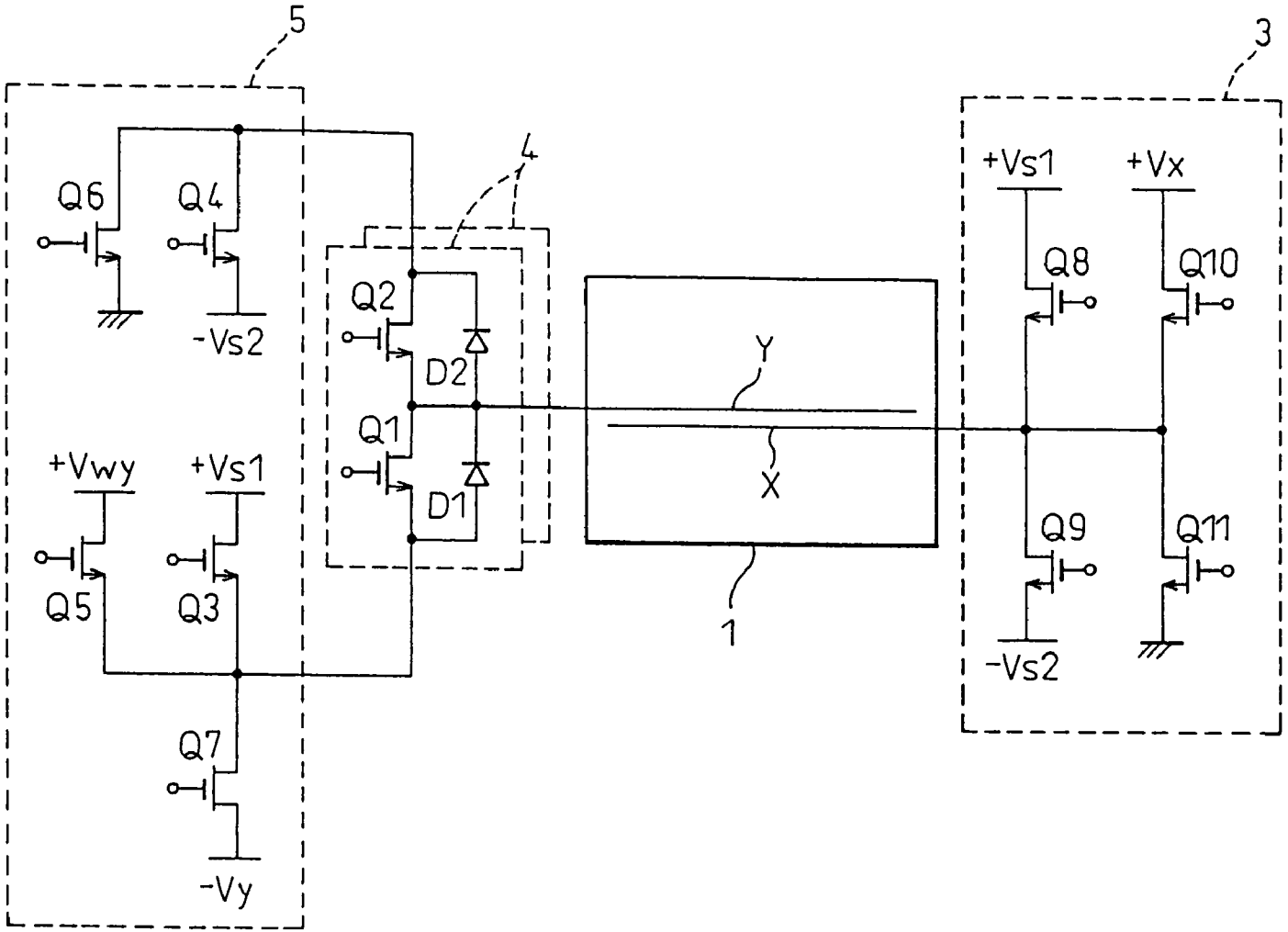
FIG.2 Prior Art
FIG. 2 is a diagram that shows a conventional example of the X electrode and Y electrode drive circuits.

Next, the case where the capacitive load drive of the present invention is applied to the X common driver 3 and the Y common driver 5 in the plasma display apparatus will be described. The basic feature of this case lies in that a sustain transistor, to which the maximum voltage greater than the sustain voltage is applied, is composed of a high breakdown voltage device and a sustain transistor, the maximum voltage of which is the sustain voltage, is composed of a low breakdown voltage device. For example, when +Vwy is greater than +Vs1 in the circuit in FIG. 2, the transistor Q4 is composed of a high breakdown voltage device and the transistor Q3 is composed of a low breakdown voltage device. When +Vx is greater than +Vs1, the transistor Q9 is composed of a high breakdown voltage device and the transistor Q8 is composed of a low breakdown voltage device.

Figure 1:
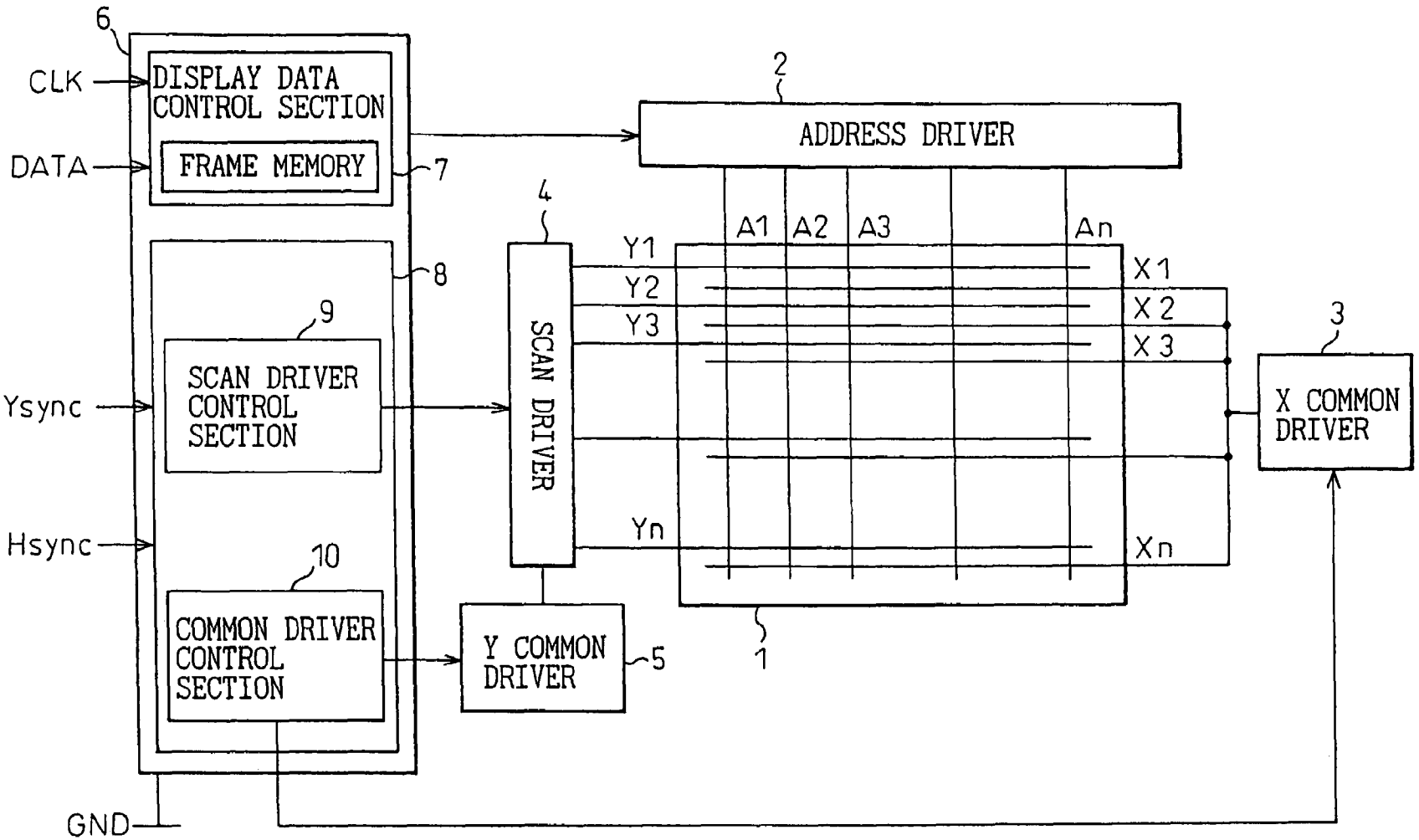
FIG.1 Prior Art
FIG. 1 is a diagram that shows the entire structure of the plasma display apparatus.

Next, a concrete embodiment in which the present invention is applied to the X common driver 3 and the Y common driver 5 in the plasma display apparatus shown in FIG. 1 is described. In this plasma display apparatus, +Vs1 and −Vs2 are applied as the sustain voltage. The reset voltage Vw, applied to the Y electrode during reset, is greater than +Vs1 and +Vx, applied to the X electrode during address, is also greater than +Vs1.

Figure 15:
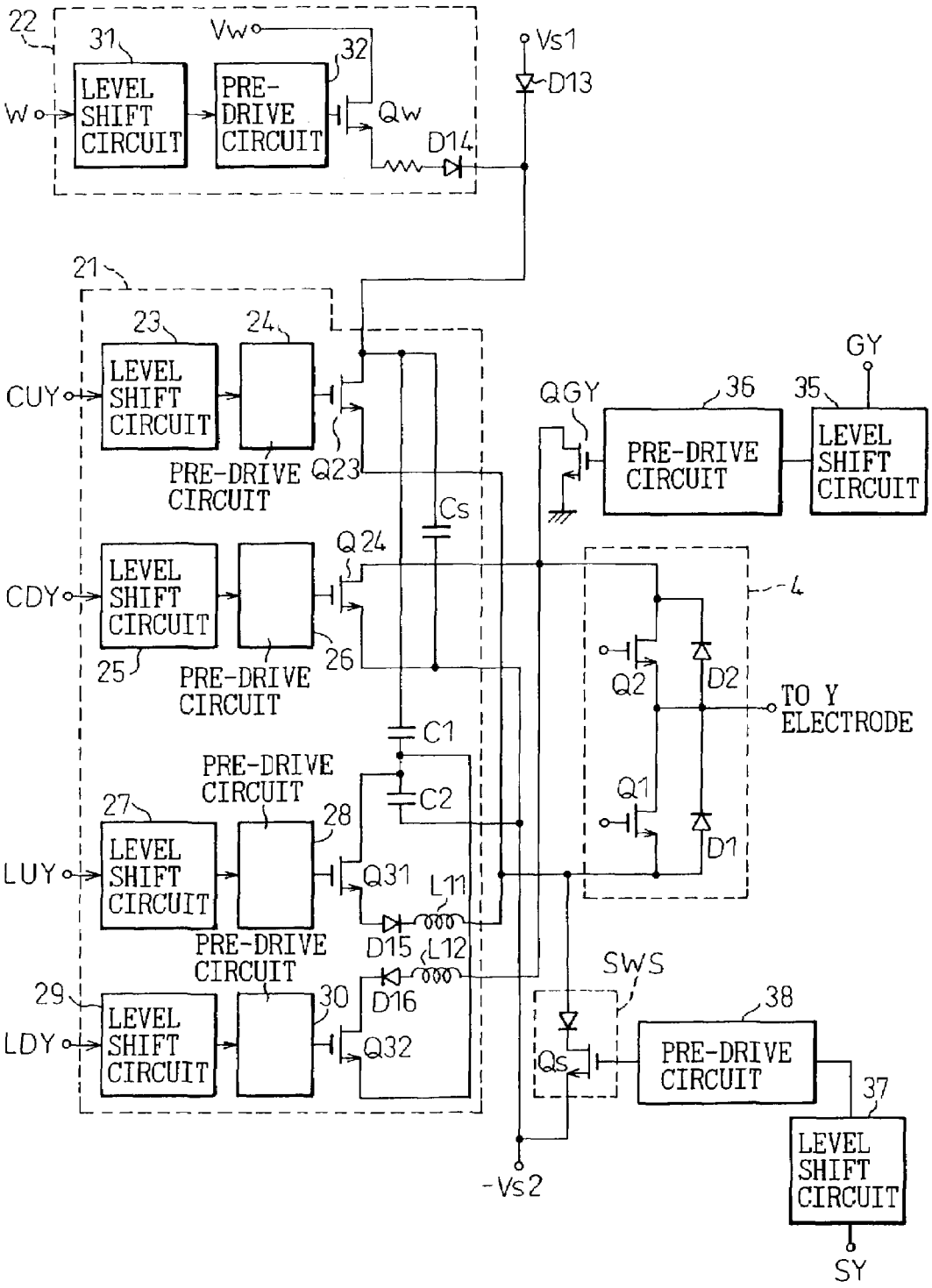
FIG. 15 is a diagram that shows the structure of the Y electrode drive circuit of the plasma display apparatus in the ninth embodiment of the present invention.

FIG. 15 is a diagram that shows the structure of the Y electrode drive circuit including the scan driver 4 and the Y common driver 5 in the plasma display apparatus in the ninth embodiment of the present invention. As in the conventional one, the scan driver 4 comprises the transistors Q1 and Q2 connected in series, the diode D1 provided in parallel to Q1, and the diode D2 provided in parallel to Q2. Q1 and Q2 are required to perform speedy operations but they need not to have a high breakdown voltage.

The Y common driver 5 comprises a Y sustain circuit 21, a diode D13 provided between the Y sustain circuit 21 and the voltage source +Vs1, a Y reset circuit 22, a transistor QGY connected between the cathode of D2 and the ground GND, a switch SWS provided between the anode of D1 and the voltage source −Vs2, level shift circuits 35 and 37 that convert the levels of control signals GY and SY, and pre-drive circuits 36 and 38 that apply the outputs of the level shift circuits 35 and 37 to the gates of the transistors QGY and Qs. The switch SWS is configured by connecting the transistor Qs and a diode in series.

The Y sustain circuit comprises a sustain transistor Q23 that is connected to the anode of D1, a sustain transistor Q24 that is connected to the cathode of D2, a transistor Q31 that is connected to the anode of D1 via a diode D15 and an inductance device L11, a transistor Q32 that is connected to the cathode of D2 via a diode D16 and an inductance device L12, level shift circuits 23, 25, 27 and 29 that convert the levels of control signals CUY, CDY, LUY and LDY of the transistors Q23, Q24, Q31 and Q32, pre-drive circuits 24, 26, 28 and 30 that apply the outputs of the level shift circuits 23, 25, 27, 29 to the gates of the transistors Q23, Q24, Q31 and Q32, a capacitor C1 that is connected between the terminals of Q23 and Q31, a capacitor C2 that is connected between the terminals of Q24 and Q32, and a capacitor Cs that is connected between the terminals of Q23 and Q24. The transistors Q31 and Q32, the capacitors C1 and C2, the diodes and the inductance devices make up a power recovery circuit that recovers power when switching the voltages to be applied to the Y electrode in the sustain discharge period to use it for the next switching. As this circuit has been disclosed in Japanese Unexamined Patent Publication (Kokai) No. 7-160219, a detailed description is omitted here.

The Y reset circuit comprises a transistor Qw, one of the terminals of which is connected to the voltage source Vw and the other terminal of which is connected to the other terminal of Q23 via a resistor and a diode, a level shift circuit 31 that converts the level of a control signal W, and a pre-drive circuit 32 that applies the output of the level shift circuit 31 to the gate of the transistor Qw.

The transistors Q23, Q24, Q31, Q32 and Qw correspond to SWCU, SWCD, SWLU, SWLD and SWR, respectively, in the capacitive load drive circuit described above, and D13, D14, D15, D16, L11, L12, C1 and C2 correspond to D3, D4, D5, D6, L1, L2, CP1 and CP2, respectively.

In the circuit in the ninth embodiment, the sustain transistors Q23 and Q31 are composed of low breakdown voltage devices and the sustain transistors Q24 and Q32 are composed of high breakdown voltage devices. The level shift circuits 23, 25, 27, 29 and 31 serve to shift the level of the control signal generated with GND being a reference to the reference level (−Vs2) of the output device.

Figure 16:
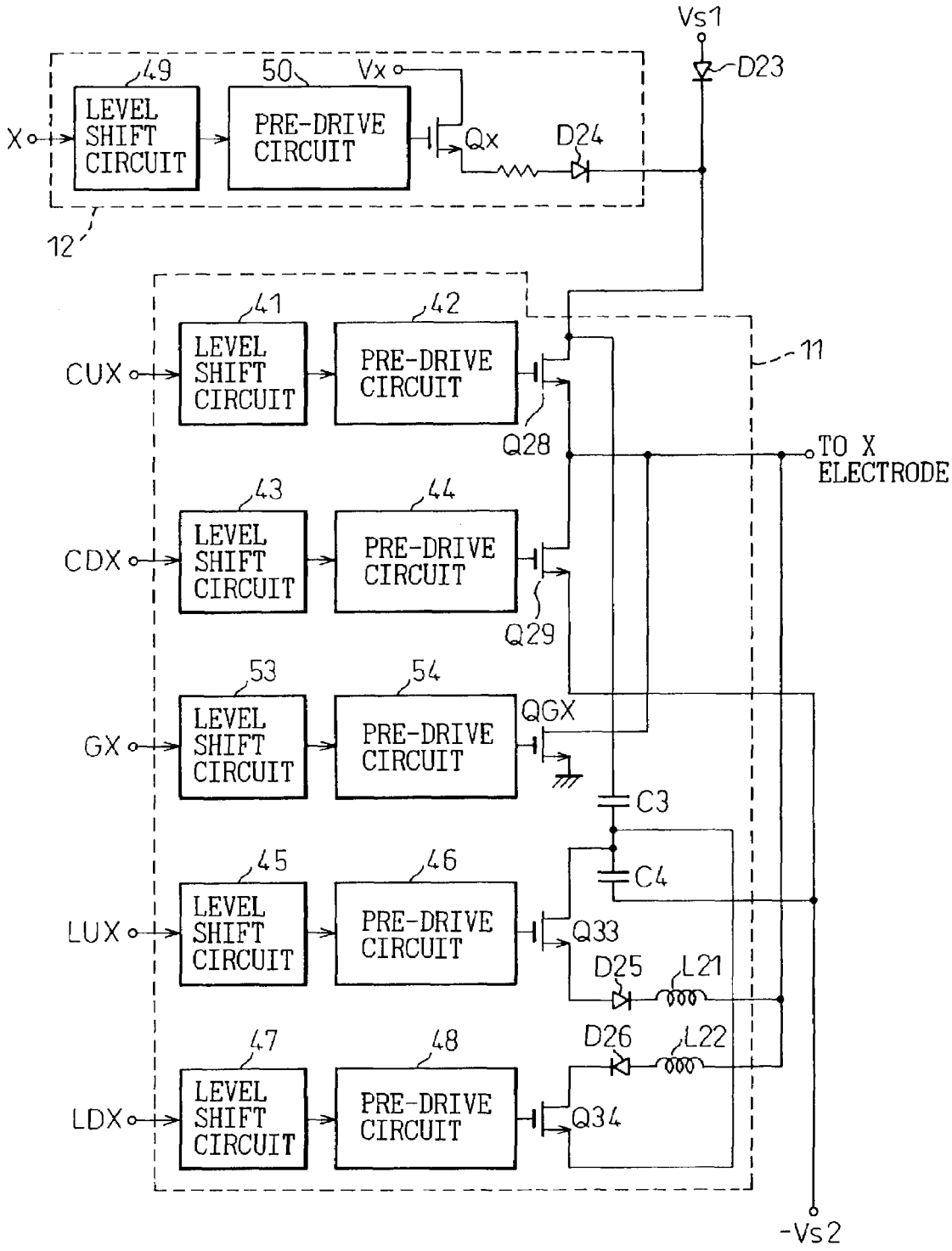
FIG. 16 is a diagram that shows the structure of the X electrode drive circuit in the ninth embodiment.

FIG. 16 is a diagram that shows the structure of the X common driver 3 in the ninth embodiment. The X common driver 3 comprises an X sustain circuit 11, a diode D23 that is provided between the X sustain circuit 11 and the voltage source +Vs1, and a Vx circuit 12.

The X sustain circuit 11 comprises sustain transistors Q28 and Q29 that are connected to the X electrode, a transistor Q33 that is connected to the X electrode via a diode D25 and an inductance L21, a transistor Q34 that is connected to the X electrode via a diode D26 and an inductance L22, a transistor QGX that is connected between the X electrode and GND, level shift circuits 41,43, 45, 47 and 53 that convert the levels of control signals CUX, CDX, LUX, LDX and GX of the transistors Q28, Q29, Q33, Q34 and QGX, pre-drive circuits 42, 44, 46, 48 and 54 that apply the outputs of the level shift circuits 41, 43, 45, 47 and 53 to the gates of the transistors Q28, Q29, Q33, Q34 and QGX, a capacitor C3 that is connected between the terminals of Q28 and Q33, and a capacitor C4 that is connected between the terminals of Q29 and Q34. The transistors Q33 and Q34, the capacitors C3 and C4, the diodes and the inductances make up a power recovery circuit that recovers power, when switching the voltages to be applied to the Y electrode in the sustain discharge period, to use it for the next switching The Vx circuit 12 comprises a transistor Qx, one of the terminal of which is connected to the voltage source Vx and the other terminal of which is connected to the other terminal of Q28 via a resistor and a diode D24, a level shift circuit 49 that converts the level of a control signal X, and a pre-drive circuit 50 that applies the output of the level shift circuit 49 to the gate of the transistor Qx.

The transistors Q28, Q29, Q33, Q34 and Qx correspond to SWCU, SWCD, SWLU, SWLD and SWR, respectively, in the capacitive load drive circuit as described above, and D23, D24, D25, D26, L21, L22, C3 and C4 correspond to D3, D4, D5, D6, L1, L2, CP1 and CP2, respectively.

The sustain transistors Q28 and Q33 are composed of low breakdown voltage devices and the sustain transistors Q29 and Q34 are composed of high breakdown voltage devices. The level shift circuits 41, 43, 45, 47 and 49 serve to shift the level of the control signal generated with GND being reference to the reference level (−Vs2) of the output device.

Figure 17:
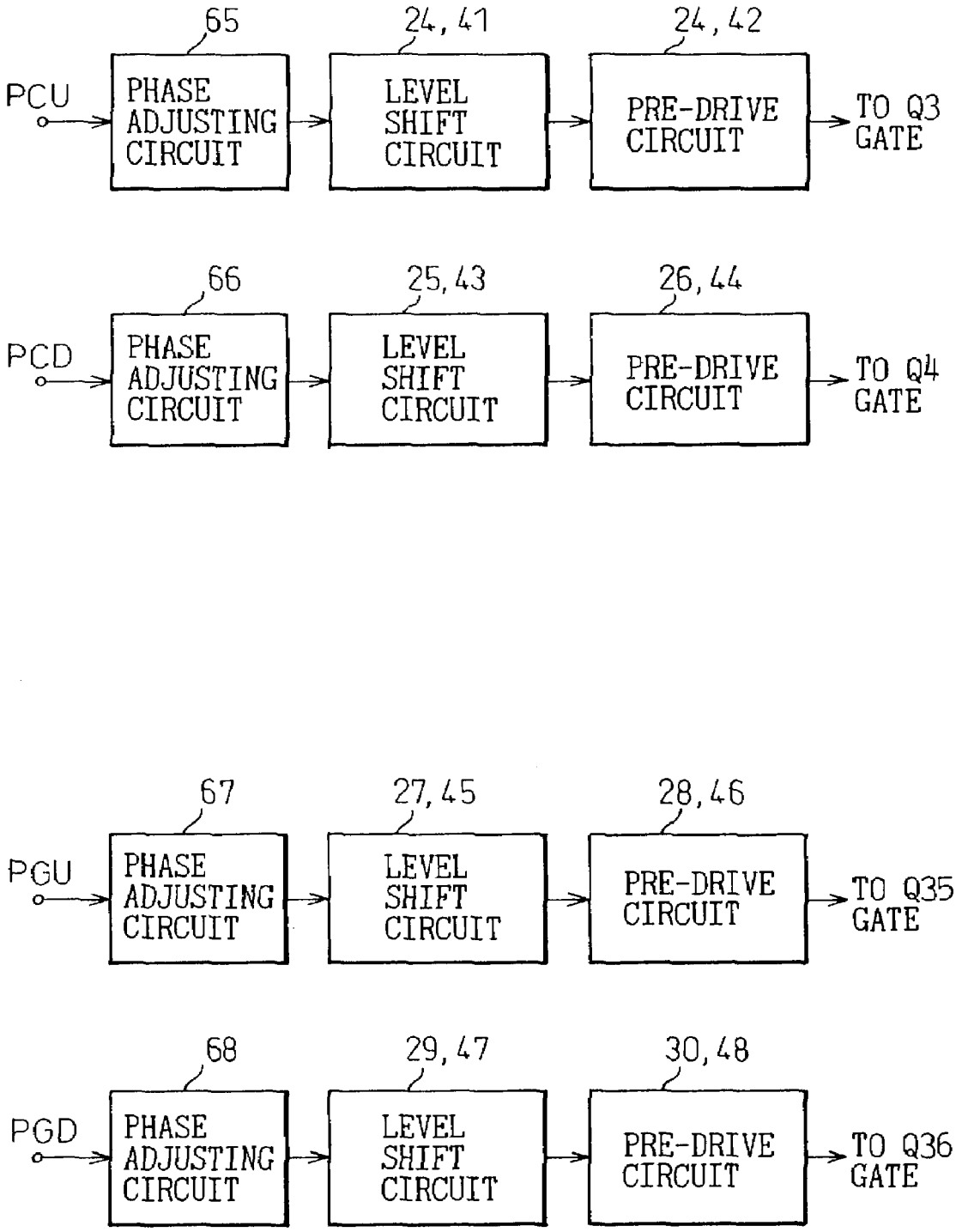
FIG. 17 is a diagram that shows the structure that includes the phase adjusting circuit in the ninth embodiment.

In the ninth embodiment, control signals PCU, PCD, PGU and PGD to be supplied to the Y sustain circuit 21 and the X sustain circuit 11 are supplied to level shift circuits after phase-adjusted in phase adjusting circuits 65, 66, 67 and 68, as shown in FIG. 17. In this way, it will be possible to adjust the phase of the change edge of the sustain pulse with precision, to apply the sustain pulse with a proper timing even when transistors of different breakdown voltage are used, and to improve the efficiency of power recovery.

Figure 18A:
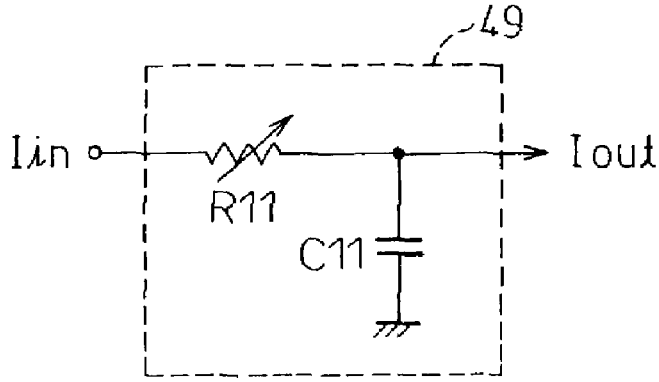
FIG. 18A to FIG. 18C are diagrams that show the examples of the phase adjusting circuit structure.
Figure 18B:
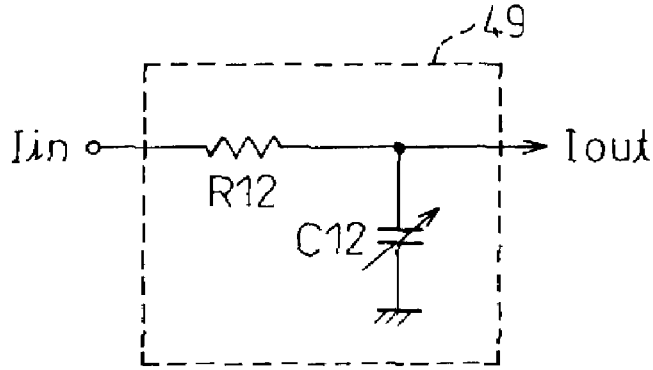
Figure 18C:
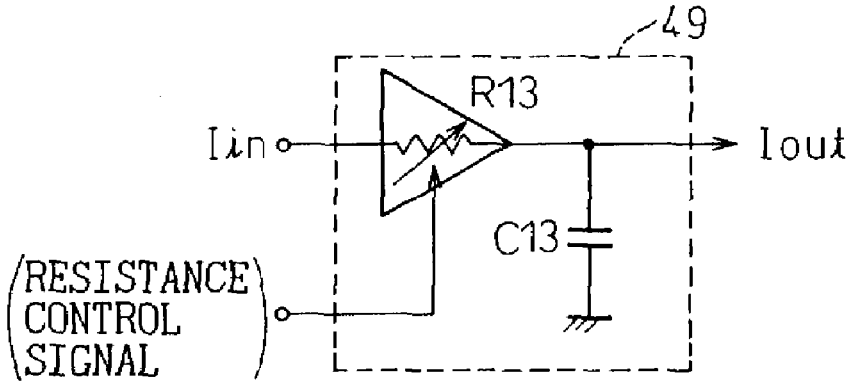

The phase adjusting circuit can be realized by, for example, circuits shown in FIG. 18A to FIG. 18C. FIG. 18A shows an example in which a variable resistor R11 and a capacitor C11 are combined, FIG. 18B shows an example in which a resistor R12 and a variable capacitor C12 are combined, and FIG. 18C shows an example in which an electronic variable resistor R13 and a capacitor C13 are combined.

Figure 19:
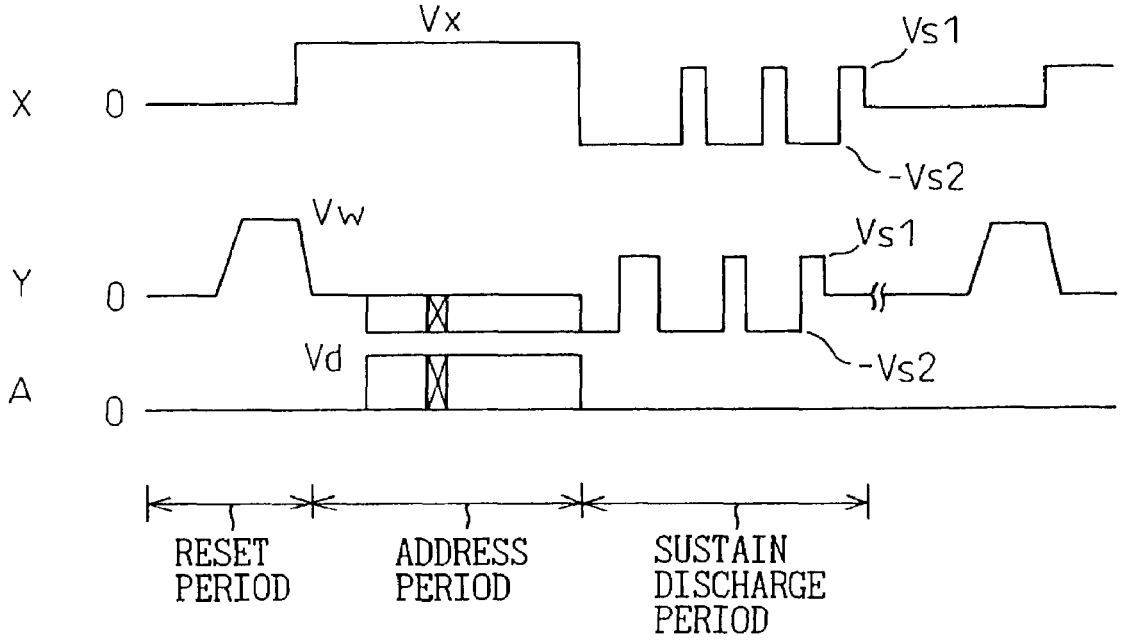
FIG. 19 is a diagram that shows the drive waveforms in the ninth embodiment.

FIG. 19 is a diagram that shows the drive waveforms used in the plasma display apparatus in the ninth embodiment. As shown schematically, in the reset period, in a state in which the X electrode and the address electrode are set to 0V, the high voltage Vw is applied to the Y electrode to cause an erase discharge to occur. In the address period, in a state in which +Vs is being applied to the X electrode, the scan pulse of −Vs2 is applied sequentially to the Y electrode, and when the scan pulse is not applied, GND is applied to the Y electrode, a data voltage Vd is applied to the address electrode of a display cell in synchronization with the application of the scan pulse, and GND is applied to the address electrode of a non-display cell. In this way, all the cells are brought into a state in accordance with the display data. Although the scan pulse of −Vs2 is used here, another voltage can be used. In this case, however, it is necessary to provide a voltage source that supplies such a voltage.

In the sustain discharge period, in a state in which GND is being applied to the address electrode, +Vs1 and −Vs2 are applied sequentially to the X electrode and the Y electrode. In this case, −Vs2 is used as a base and in a state in which −Vs2 is being applied both the X electrode and the Y electrode, −Vs2 is applied again to one of them after +Vs1 is applied, and then −Vs2 is applied again to the other of them after +Vs1 is applied, and these actions are repeated. In this way, the sustain voltage Vs1+Vs2 is applied between the X electrode and the Y electrode, a sustain discharge is caused to occur in a display cell, and the display is performed.

Figure 20:
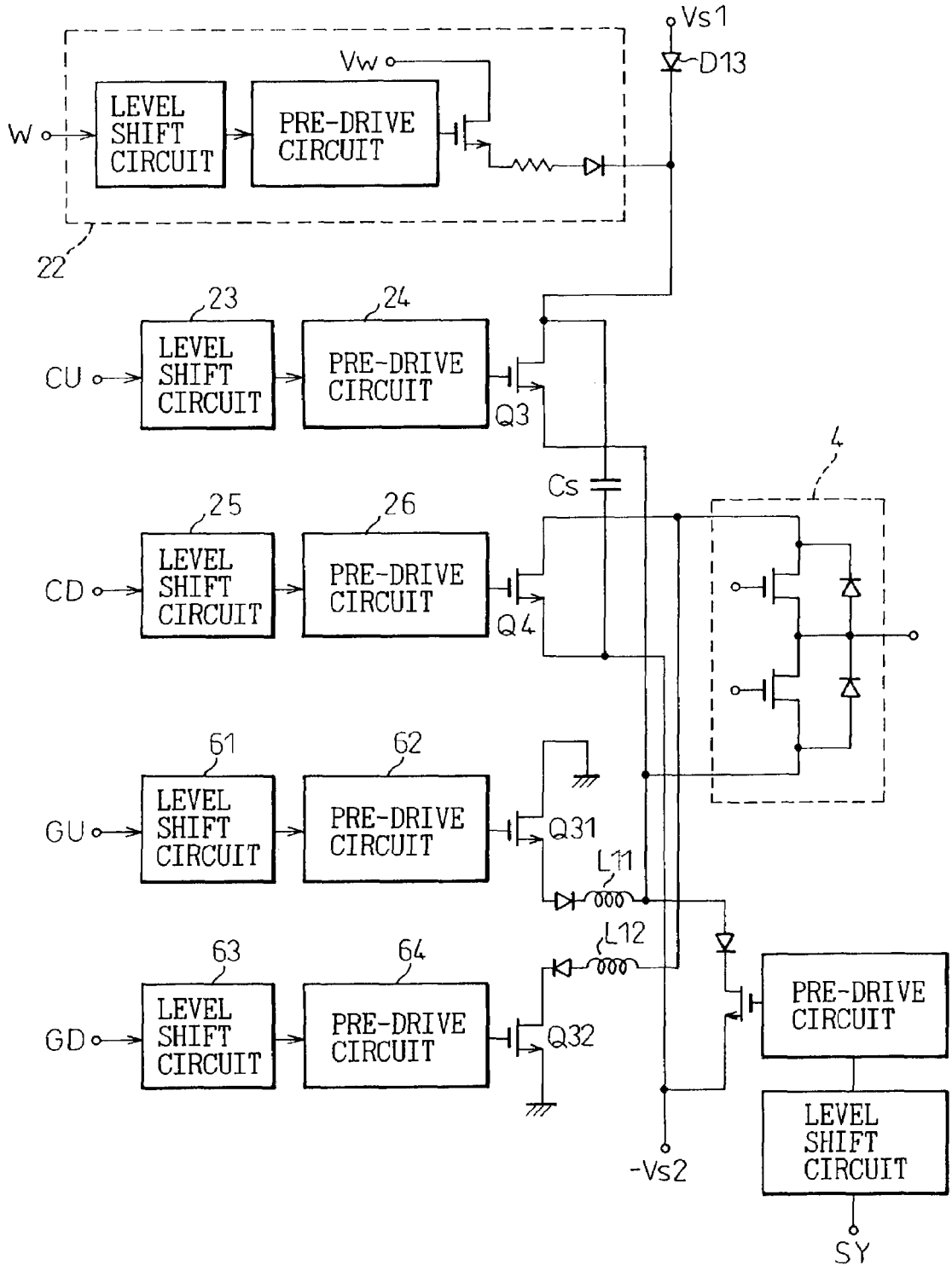
FIG. 20 is a diagram that shows the structure of the Y electrode drive circuit in the tenth embodiment of the present invention.

FIG. 20 is a diagram that shows the structure of the Y electrode drive circuit in the plasma display apparatus in the tenth embodiment of the present invention. As is obvious from a comparison with FIG. 15, this circuit differs from that in the ninth embodiment in that the transistors Q31 and Q32, that is, SWLU and SWLD except for the capacitors C1 and C2 are connected to GND. On the other hand, it is possible to omit the inductors L11 and L12. Other operations are the same as those in the ninth embodiment. The X electrode drive circuit in the tenth embodiment is the same as that in the ninth embodiment.

Figure 21:
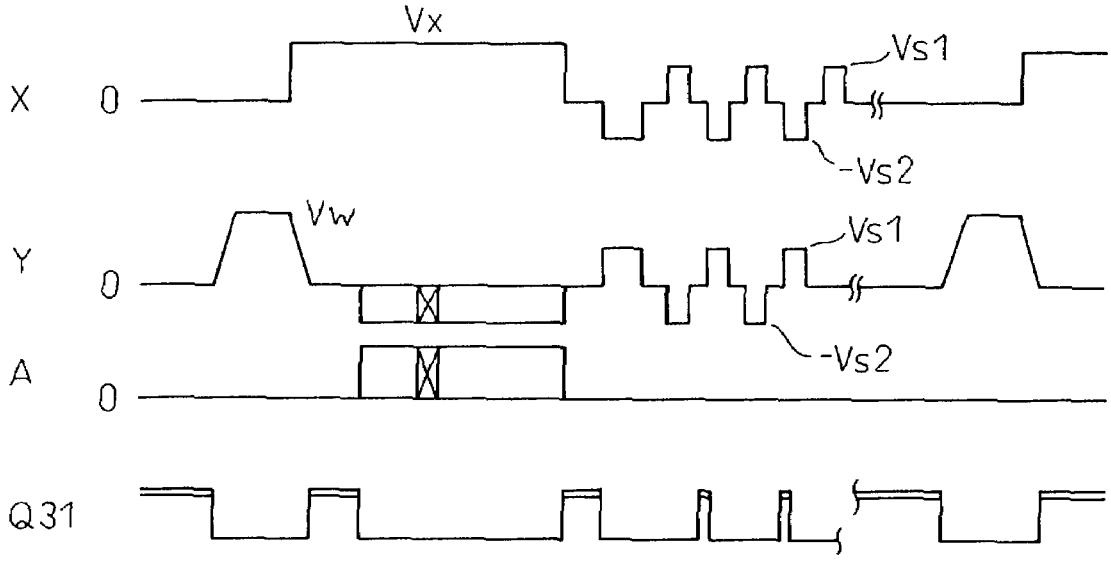
FIG. 21 is a diagram that shows the drive waveforms in the tenth embodiment.

FIG. 21 is a diagram that shows the drive waveforms and the on/off operations of the transistor Q31 in the plasma display in the tenth embodiment. The drive waveforms differ from those in the ninth embodiment in that the voltage to be applied to the X electrode and the Y electrode is temporarily set to GND when it is switched between Vs1 and −Vs2 in the sustain discharge period. As described in the second embodiment, it is possible to reduce the amount of change in voltage at the leading edge and the falling edge of the sustain discharge pulse to reduce the power consumption by providing the level differences in the sustain discharge pulse waveforms. On the other hand, as the transistors Q31 and Q32 are connected to GND, it is possible to set the Y electrode to the GND potential by turning these on.

Figure 22:
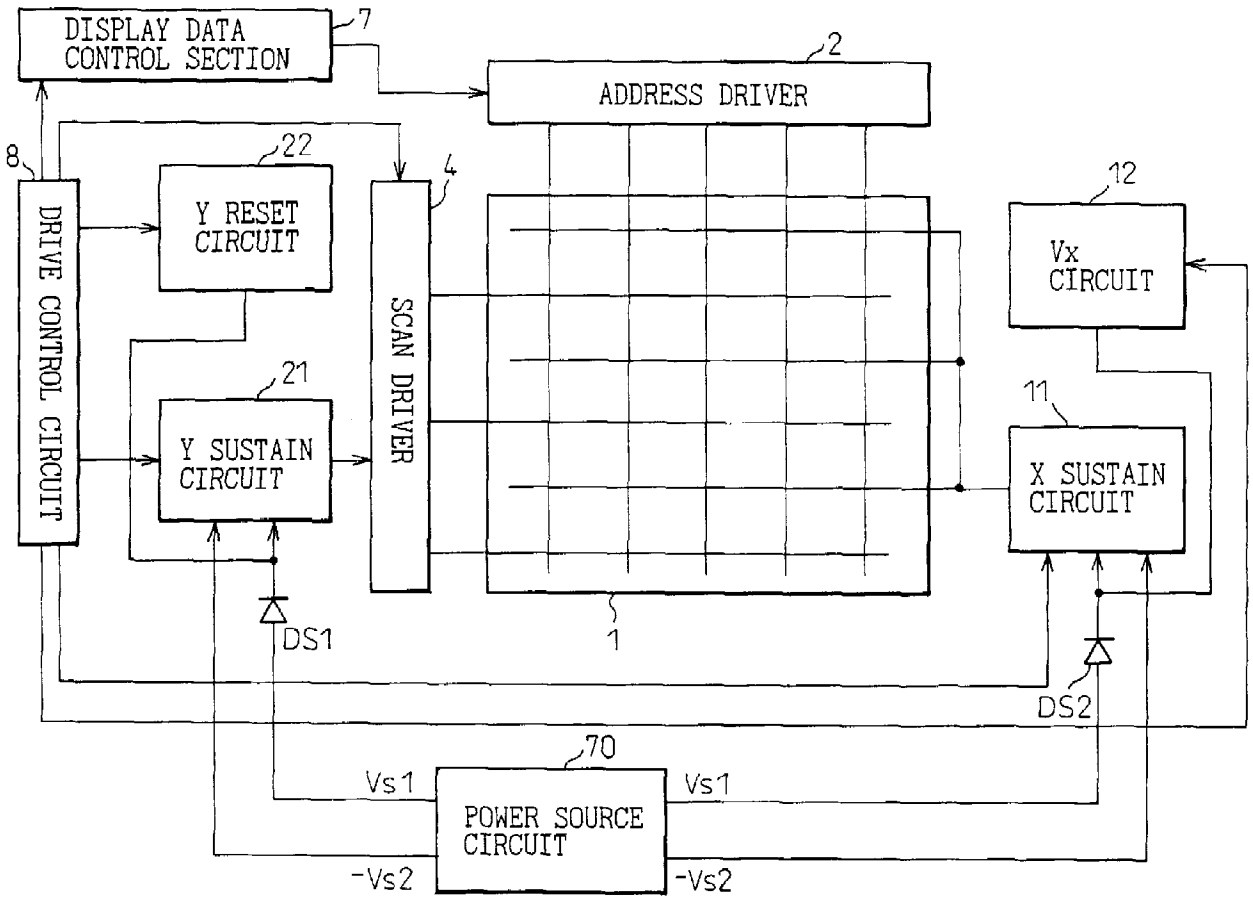
FIG. 22 is a diagram that shows the entire structure of the plasma display apparatus in the eleventh embodiment of the present invention.

FIG. 22 is a diagram that shows the general structure of the plasma display apparatus in the eleventh embodiment of the present invention. In the plasma display apparatus in the eleventh embodiment, +Vs1 and −Vs2 are applied as the sustain voltage. A power source circuit 70, therefore, generates +Vs1 and −Vs2 and supplies them to the X sustain circuit 11 and the Y sustain circuit 21 via diodes DS1 and DS2.

Figure 23A:
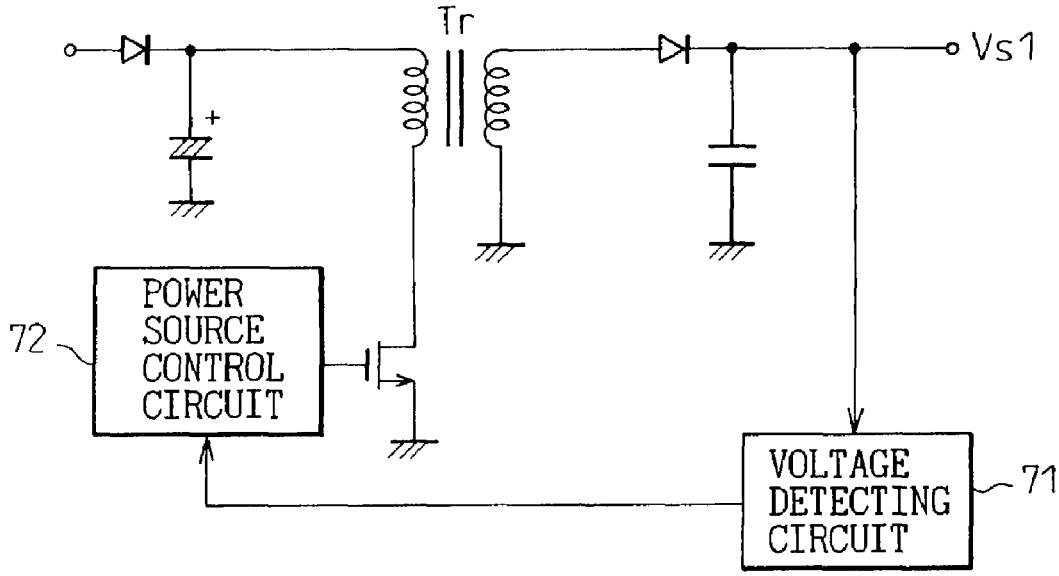
FIG. 23A and FIG. 23B are diagrams that show the examples of the power source circuit structure in the eleventh embodiment.
Figure 23B:
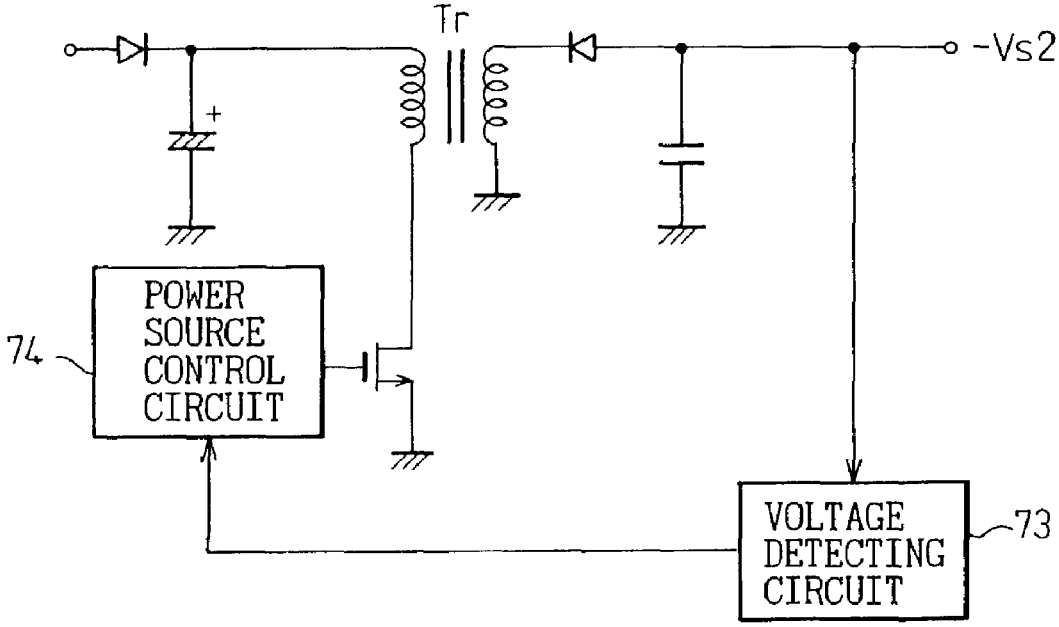

FIG. 23A and FIG. 23B are diagrams that show the structure examples of the power source circuit 70, wherein FIG. 23A shows the structure of the portion where the power source voltage +Vs1 is generated and FIG. 23B shows that where the power source voltage −Vs2 is generated. As shown schematically, the current flow on the primary side is controlled by controlling transistors in power source control circuits 72 and 74 so that they are turned on/off. The intermittent flow of the current on the primary side generates an alternating voltage on the secondary side in accordance with the ratio of times of windings of a transformer Tr. This voltage is rectified, smoothed by a capacitor, and +Vs1 and −Vs2 are generated. The amount of charges to be supplied from the output terminals of the power source voltages +Vs1 and −Vs2 differ depending on displayed images. Because of this, the output +Vs1 and −Vs2 are detected by voltage detecting circuits 71 and 73 and the detected values are fed back to the power source control circuits 72 and 74. The power source control circuits 72 and 74 change the duty ratio, with which transistors are turned on, according to the detected voltage so that the constant power source voltages +Vs1 and −Vs2 are always output.

Figure 24A:
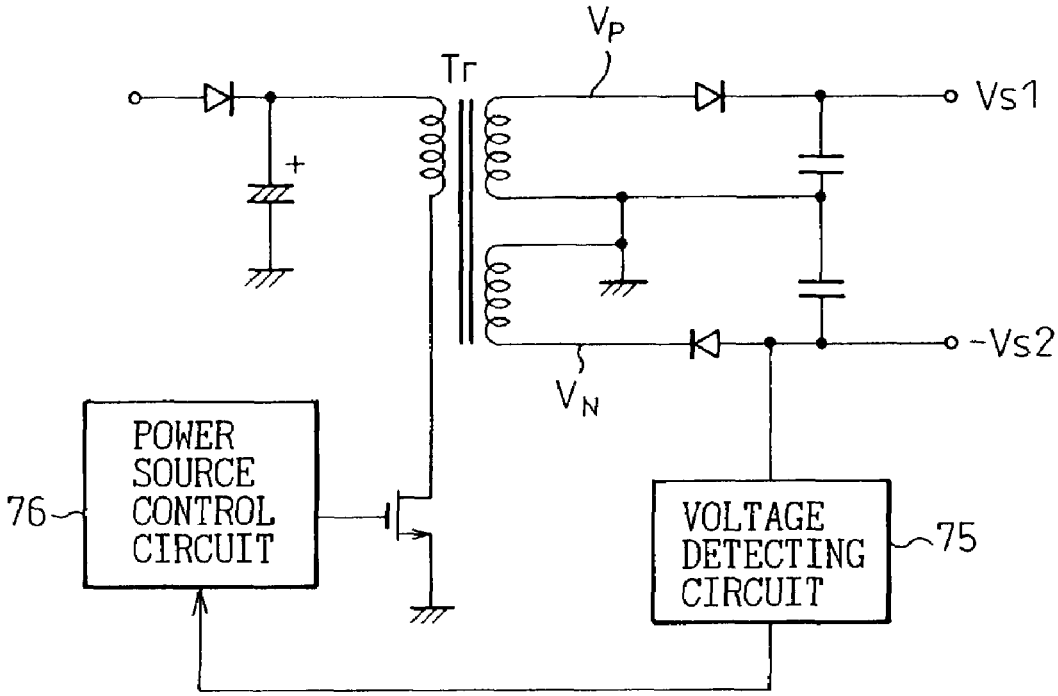
FIG. 24A and FIG. 24B are diagrams that show the examples of the power source circuit structure in the eleventh embodiment.
Figure 24B:
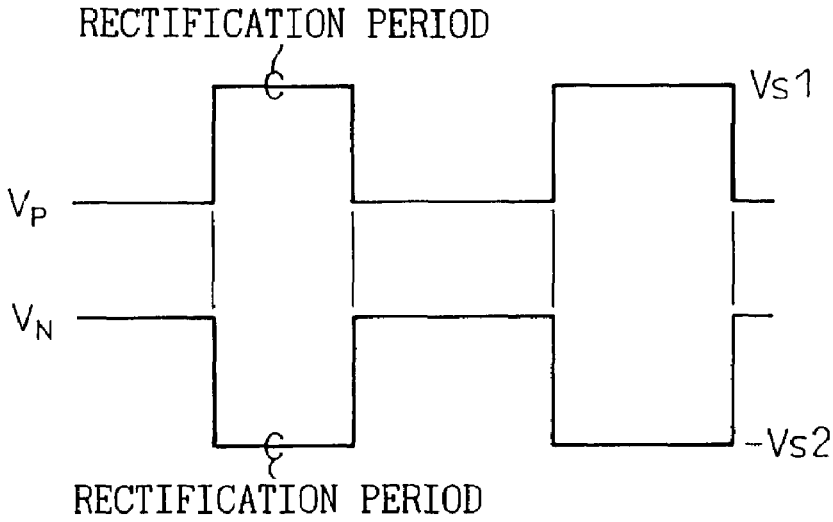

FIG. 24A and FIG. 24B are diagrams that show other structure examples of the power source circuit 70, wherein FIG. 24A illustrates the structure and FIG. 24B illustrates the operations. As shown in FIG. 24A, one terminal of each of the two coils on the secondary side is connected to the other.

In the circuit shown in FIG. 24A, the voltage −Vs2 is detected by a voltage detecting circuit 75 and a drive signal to be supplied from a power source control circuit 76 to the transistors is controlled so that the voltage −Vs2 is kept constant. The period during which a load current flows from the output terminal of the voltage −Vs2 corresponds to the rectification period denoted by voltage VN in FIG. 24B. When the rectification period of the VN waveform coincides with that of the voltage VP, a load current flows also from the output terminal of the voltage −Vs2. By designing a transformer Tr shown in FIG. 24A so as to establish such a polarity, it is possible for the periods, during which a load current flows from the output terminal of the voltage Vs1 and that during which a load current flows from the output terminal of the voltage −Vs2, to coincide. As a result, even when only the voltage −Vs2 is detected, as shown above, it is possible to adjust the voltage Vs1 to a proper voltage. The present invention brings forth an effect that the circuits such as a voltage detecting circuit and a voltage control circuit can be realized by a single circuit, instead of the circuits shown in FIG. 23A and FIG. 23B, by using the circuit shown in FIG. 24A. This is also applicable to the case where only the voltage Vs1, instead of the −Vs2, is detected and controlled.

Figure 25:
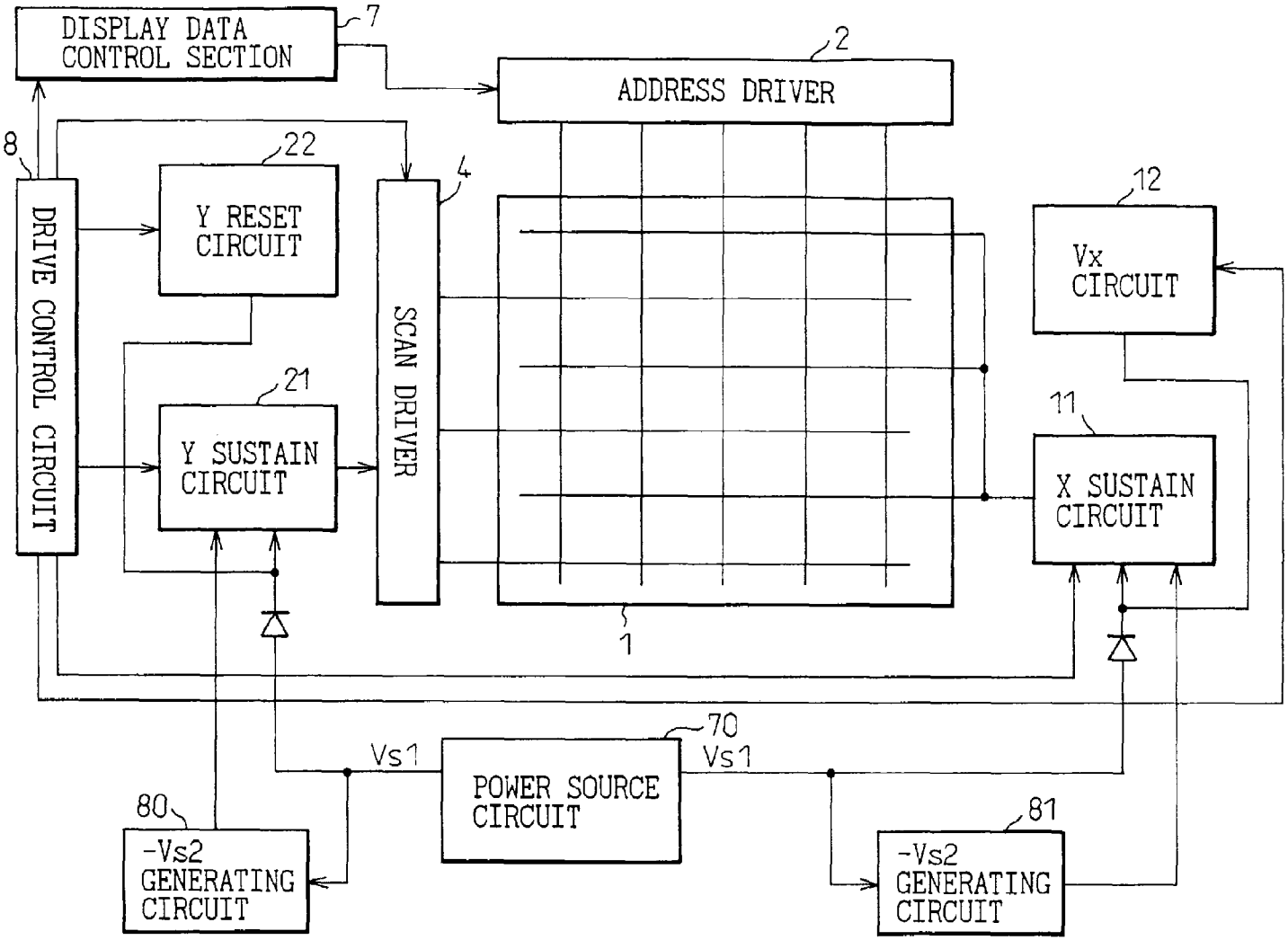
FIG. 25 is a diagram that shows the entire structure of the plasma display apparatus in the twelfth embodiment of the present invention.

FIG. 25 is a diagram that shows the general structure of the plasma display apparatus in the twelfth embodiment of the present invention. The power source circuit 70 in FIG. 25 generates the power source voltage Vs1. −Vs2 generating circuits 80 and 81 generate the power source voltage −Vs2 by the DC/DC conversion of the voltage Vs1.

Figure 26:
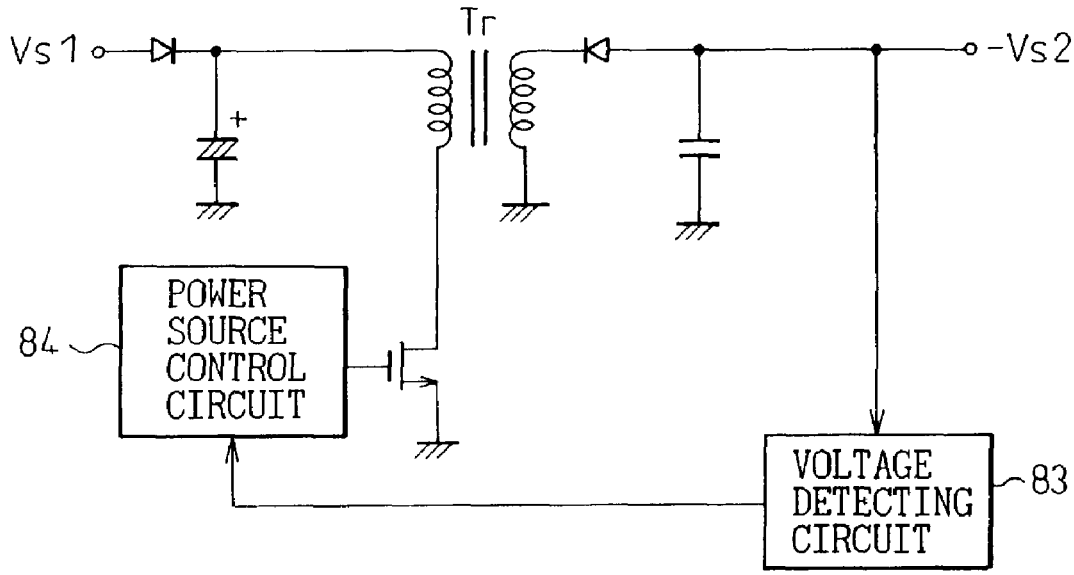
FIG. 26 is a diagram that shows the example of the power source circuit structure in the twelfth embodiment.

Concrete examples of the structure of the −Vs2 generating circuits 80 and 81 are shown in FIG. 26. Although this circuit differs from that shown in FIG. 23B in that the voltage Vs1 is used as an input voltage, the basic operations are the same as those of the circuit in FIG. 23B.

Figure 27:
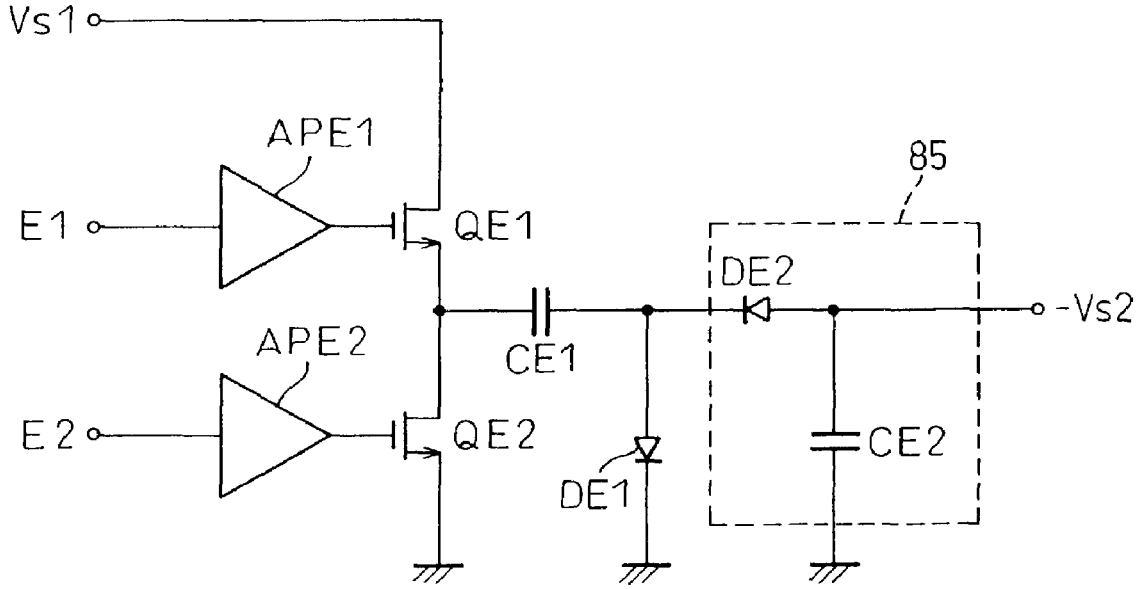
FIG. 27 is a diagram that shows the example of the power source circuit structure in the twelfth embodiment.

FIG. 27 shows other concrete examples of the −Vs2 generating circuits 80 and 81. In this circuit, a pulse of voltage amplitude Vs1 is generated by alternately turning on/off a first power source switch QE1 and a second power source switch QE2. By clamping the high level of the pulse to GND using a clamping diode DE1, the low level of the pulse can be set to the voltage −Vs1. By rectifying the voltage −Vs1 in a rectifying circuit composed of a diode DE2 and a capacitor CE2, a direct current voltage −Vs2 (=−Vs1) is generated. The circuit shown in FIG. 27 has an advantage compared to that shown in FIG. 26 in that the voltage −Vs2 can be generated without using a transformer.

In the plasma display apparatus in the twelfth embodiment, the number of types of the sustain voltage generated in the power source circuit 70 can be reduced. Moreover, although the method of generating the voltage −Vs2 using the voltage Vs1 is described in the twelfth embodiment, it is also possible to generate the voltage −Vs2 in a power source circuit and then generate Vs1 by the DC/DC conversion.

In the capacitive load drive circuit of the present invention, it is possible to use low breakdown voltage devices for output devices, to lower the saturation voltage of a device, to suppress the number of devices parallelly driven, and to reduce the size of a chip, resulting in a reduction in cost.

Moreover, according to the plasma display apparatus of the present invention, it is possible to use low breakdown voltage devices for output devices in a capacitive load drive circuit used in such as a sustain circuit, to lower the saturation voltage of a device, to reduce the number of devices parallelly drive, and to reduce the size of a chip, resulting in a reduction in cost.

We claim:

1. A capacitive load drive circuit in which a low potential reference voltage, a first positive voltage, and a second voltage greater than the first voltage are supplied to a capacitive load, comprising:

a first switch that supplies the first voltage to the capacitive load;

a second switch that supplies the low potential reference voltage to the capacitive load;

a first phase adjusting circuit that adjusts the phase of a drive pulse that drives the first switch; and a second phase adjusting circuit that adjusts the phase of a drive pulse that drives the second switch, wherein the voltage rating of the first switch is less than that of the second switch, and wherein the first voltage is supplied to the first switch via a first diode, the second voltage is supplied to the first switch via an additional switch and a second diode, and the first switch is driven so as to be always on while the additional switch is on.

2. A capacitive load drive circuit, as set forth in claim 1, wherein a third switch that supplies a third voltage between the low potential reference voltage and the first voltage to the capacitive load when a voltage to be supplied to the capacitive load is changed from the low potential reference voltage to the first voltage, a fourth switch that supplies the third switch when a voltage to be supplied to the capacitive load is changed from the first voltage to the low potential reference voltage, a third phase adjusting circuit that adjusts the phase of a drive pulse that drives the third switch, and a fourth phase adjusting circuit that adjusts the phase of a drive pulse that drives the fourth switch are provided, and the voltage rating of the third switch is less than that of the fourth switch.

3. A capacitive load drive circuit, as set forth in claim 1, wherein the first switch and the second switch are composed of power MOSFETs.

4. A capacitive load drive circuit, as set forth in claim 1, wherein the low potential reference voltage is a negative voltage.

5. A plasma display apparatus in which at least either a sustain electrode drive circuit or a scan electrode drive circuit comprises the capacitive load drive circuit set forth in claim 1.

6. A capacitive load drive circuit in which a low potential reference voltage, a first positive voltage, and a second voltage greater than the first voltage are supplied to a capacitive load, respectively, comprising:

a first switch that is composed of a power MOSFET and supplies the first voltage to the capacitive load; and a second switch that is composed of an insulated gate bipolar transistor and supplies the low potential reference voltage to the capacitive load, wherein the voltage rating of the first switch is less than that of the second switch, and wherein the first voltage is supplied to the first switch via a first diode, the second voltage is supplied to the first switch via an additional switch and a second diode, and the first switch is driven so as to be always on while the additional switch is on.

7. A capacitive load drive circuit, as set forth in claim 6, further comprising:

a first phase adjusting circuit that adjusts the phase of a drive pulse that drives the first switch; and a second phase adjusting circuit that adjusts the phase of a drive pulse that drives the second switch.

8. A capacitive load drive circuit in which a reference voltage, a first voltage and a second voltage are supplied to a capacitive load, comprising:

a first switch that supplies the first voltage to the capacitive load and a second switch that supplies the reference voltage to the capacitive load;

a first phase adjusting circuit that adjusts the phase of a drive pulse that drives the first switch; and a second phase adjusting circuit that adjusts the phase of a drive pulse that drives the second switch, wherein the first voltage is supplied to the first switch via a first diode, the second voltage is supplied to the first switch via an additional switch and a second diode, and the first switch is driven so as to be always on while the additional switch is on.

* * * * *